US007922304B2

(12) United States Patent
Kubo

(10) Patent No.: US 7,922,304 B2
(45) Date of Patent: Apr. 12, 2011

(54) LIQUID DROPLET JETTING HEAD

(75) Inventor: Tomoyuki Kubo, Nagoya (JP)

(73) Assignee: Brother Kogyo kabushiki Kaisha, Aichi-Ken (JP)

( * ) Notice: Subject to any disclaimer, the term of this patent is extended or adjusted under 35 U.S.C. 154(b) by 371 days.

(21) Appl. No.: 12/263,180

(22) Filed: Oct. 31, 2008

(65) Prior Publication Data

US 2009/0109264 A1 Apr. 30, 2009

(30) Foreign Application Priority Data

Oct. 31, 2007 (JP) ..... 2007-283397
Oct. 31, 2007 (JP) ..... 2007-283399

(51) Int. Cl.
*B41J 2/045* (2006.01)

(52) U.S. Cl. ..... 347/71; 347/47; 347/50; 347/68; 347/69; 347/70; 347/72

(58) Field of Classification Search ..... 347/47, 347/50, 68–72
See application file for complete search history.

(56) References Cited

U.S. PATENT DOCUMENTS 6,966,635 B2 * 11/2005 Miyata et al. ..... 347/70
7,008,048 B2 * 3/2006 Sakaida ..... 347/68

FOREIGN PATENT DOCUMENTS

JP 10-303517 11/1998
JP 2006-44196 2/2006

* cited by examiner

*Primary Examiner* — Ryan Lepisto
*Assistant Examiner* — Guy G Anderson
(74) *Attorney, Agent, or Firm* — Frommer Lawrence & Haug LLP

(57) ABSTRACT

An ink-jet head includes a channel unit in which a channel is formed, a piezoelectric unit, and a wiring unit stacked on the piezoelectric unit. The wiring unit has a substrate, an individual supply-terminal group which includes a plurality of individual supply-terminals, a common supply-terminal, and an isolative covering layer, which is stacked on a surface of the substrate facing the piezoelectric unit. In the covering layer, a trap groove which runs between the individual supply-terminals and the common supply-terminal, and surrounds the individual supply-terminal group is formed. Accordingly, there is provided a liquid droplet jetting head which is capable of preventing a shorting between the individual drive electrodes of the piezoelectric unit, and between the individual supply-terminals of the wiring unit, due to the liquid entered from outside.

13 Claims, 15 Drawing Sheets

LIQUID DROPLET JETTING HEAD

CROSS REFERENCE TO RELATED APPLICATION

The present application claims priority from Japanese Patent Applications No. 2007-283399, filed on Oct. 31, 2007 and No. 2007-283397, filed on Oct. 31, 2007, the disclosures of which are incorporated herein by reference in its entirety.

BACKGROUND OF THE INVENTION

1. Field of the Invention

The present invention relates to a liquid droplet jetting head which jets liquid droplets.

2. Description of the Related Art

As a liquid jetting apparatus such as an ink-jet printer, there is a liquid jetting apparatus which includes: a channel unit in which liquid channels communicating with nozzle holes for jetting liquid droplets; a piezoelectric unit which applies a jetting pressure to the liquid in the liquid channel to jet the liquid from the nozzle holes; and a liquid droplet jetting head on which a wiring unit for outputting a drive signal for the piezoelectric unit is stacked (for example, refer to Japanese Patent Application Laid-open No. 2006-44196 (FIG. 5)).

More concretely, as it has been disclosed in Japanese Patent Application Laid-open No. 2006-44196, this type of liquid droplet jetting head includes a channel unit in which a plurality of plates having a rectangular shape in a plan view is stacked and adhered, a piezoelectric unit having a plurality of stacked piezoelectric layers and a wiring unit in the form of a flexible belt. The piezoelectric unit is stacked on an upper surface of the channel unit, and one end of the wiring unit is stacked on and adhered to an upper surface of the piezoelectric unit. Moreover, a plurality of drive electrodes is arranged on the upper surface of the piezoelectric unit, and a plurality of supply-terminals arranged to face the drive electrodes is provided to a lower surface (surface facing the upper surface of the piezoelectric unit) of a sheet shaped substrate of the wiring unit. Furthermore, these drive electrodes and the supply-terminals are connected electrically via solder. The channel unit has an ink inflow port which is to be connected to an ink outflow port of an ink tank (ink storage portion), and an ink from the ink tank is supplied into the channel unit.

On the other hand, an invention in which a lateral groove which prevents from flowing an electroconductive adhesive is formed to prevent a shorting (a short-circuit) with the other electrode terminal by leaking of the electroconductive adhesive, at the time of connecting electrically the electrode terminals via the electroconductive adhesive has hitherto been proposed (for example, refer to Japanese Patent Application Laid-open No. H10-303517). In Japanese Patent Application Laid-open No. H10-303517, an insulation between the electrode terminals which are to be insulated electrically is maintained by trapping the leaked electroconductive adhesive in the lateral groove.

SUMMARY OF THE INVENTION

Incidentally, in the liquid droplet jetting head as disclosed in Japanese Patent Application Laid-open No. 2006-44196, there is a fear that the ink leaks from a connecting portion between the ink outflow port and the ink inflow port. Moreover, there is a fear that the ink is leaked from the nozzle holes, when a user drops the ink-jet printer apparatus. In such a case, there is a fear that the leaked ink enters a small gap between the piezoelectric unit and the wiring unit. In this case, it is not preferable because the leaked liquid may cause a shorting (short-circuit) between the unexpected electrode terminals. Moreover, in the invention disclosed in Japanese Patent Application Laid-open No. H10-303517, the lateral groove is provided for preventing the shorting (short-circuit) between the adjacent electrode terminals due to spreading of the electroconductive adhesive. However, a structure which is appropriate for preventing the liquid entering from an outside has not been disclosed. For instance, when the electroconductive adhesive is once filled in the lateral groove during the connection between the terminals, it becomes impossible to prevent the liquid from entering from outside later.

Whereas, the gap is sealed to be liquid-tight by applying a liquid-type sealing agent in an opening portion of a gap between the piezoelectric unit and the wiring unit, in other words, in an opening portion of a gap along an outer periphery of the piezoelectric unit and the wiring unit. However, due to a warp (curling) of the wiring unit and an unevenness of the piezoelectric unit surface, the opening portion of the gap at the time of connecting often becomes uneven. Moreover, for the liquid-type sealing agent in general, there is a variation in a quantity applied and a volume after the sealing agent is applied decreases due to drying. Therefore, the entire opening portion might not be sealed appropriately.

Moreover, in order to deal with this, after carrying out the first application and drying of the liquid-type sealing agent, a visual check is carried out, and it is necessary to carry out the second application on a portion, which is not sealed appropriately. However, such a job is too complicated, and sealing appropriately by applying and drying once has been sought.

An object of the present invention is to provide a liquid jetting head which is capable of carrying out easily a job of applying the sealing agent, and sealing appropriately the opening portion of the gap between the piezoelectric unit and the wiring unit.

Moreover, another object of the present invention is to provide a liquid jetting head which is capable of preventing appropriately the shorting (short-circuit) between individual drive electrodes of the piezoelectric unit, and between individual supply-terminals of the wiring unit by a liquid which has entered from the outside.

The present invention has been made in view of the above-mentioned circumstances. According to a first aspect of the present invention, there is provided a liquid droplet jetting head which jets droplets of a liquid, comprising:

a channel unit in which a liquid channel through which the liquid flows is formed;

a piezoelectric unit which is stacked on the channel unit and which applies a jetting pressure to the liquid in the liquid channel, the piezoelectric unit having a plurality of drive portions which are driven by a drive signal, a plurality of individual drive electrodes each of which is connected to one of the drive portions on one surface of the piezoelectric unit, and a common drive electrode which is connected commonly to the drive portions on the one surface of the piezoelectric unit and arranged in the piezoelectric unit on an outer side of the individual drive electrodes; and a wiring unit stacked on the one surface of the piezoelectric unit and having a sheet shaped substrate; an individual supply-terminal group including a plurality of individual supply-terminals provided at positions, of a facing-surface of the wiring unit facing the substrate, corresponding to the individual drive electrodes; a common supply-terminal provided at a position of the facing-surface corresponding to the common drive electrode; and an isolative covering layer which is stacked on the facing-surface, which covers the individual supply-terminals and the common supply-terminal, and in which an opening and a trapping groove are formed, a part of the individual supply-terminals and a part of the common supply-terminal being exposed via the opening, and the trapping groove being arranged in the covering layer at an inner side of a peripheral edge portion of the covering layer corresponding to an outer peripheral edge of the piezoelectric unit to surround the individual supply-terminal group from an outer side of the individual supply-terminal group, wherein the trapping groove is open toward the piezoelectric unit and traps a liquid which enters from outside of the piezoelectric unit.

According to the first aspect of the present invention, since the trapping groove is formed at a position leaving a distance on an inner side from a peripheral edge portion corresponding to the outer peripheral edge of the piezoelectric unit, it is possible to trap in the trapping groove, the liquid which has entered from the outside. Furthermore, since it surrounds from outer side the individual supply-terminal group which is connected individually to the drive portions which are driven by the drive signal, it is possible to prevent appropriately a shorting, between the individual supply-terminals and the individual drive electrodes, which affect the drive, due to the entry of the liquid, and to prevent an effect on the liquid droplet jetting drive.

In the liquid droplet jetting head of the present invention, the trapping groove may partition between the individual supply-terminal group and the common supply-terminal. In this case, in addition to the effect mentioned above, the trapping groove is arranged on an inner side of the common supply-terminal, and the trapping groove surrounds the individual supply-terminal group. Therefore, a long passage from the outside reaching up to the trapping groove is secured. Therefore, it is possible to decrease the liquid entering up to the trapping groove, and to prevent effectively the entry of the liquid to the individual supply-terminal group on the inner side of the trapping groove.

In the liquid droplet jetting head of the present invention, the substrate may have a first area which is located at one end side of the substrate and a second area which is extended from the first area to the other end side of the substrate, the first area may be connected to the piezoelectric unit, and the individual supply-terminals and the common supply-terminal may be provided in the first area; and the wiring unit may further have a plurality of individual supply-wires which are connected to the individual supply-terminals respectively, and may be extended to the second area. In this case, it is possible to drive the liquid droplet jetting head appropriately, and to trap assuredly in the trapping groove the ink entered through a gap between surfaces facing of the piezoelectric unit and the wiring unit (between a connecting surface of the piezoelectric unit and a connecting surface of the wiring unit), and to prevent the electrical shorting (short-circuit) between the individual drive electrodes and the individual supply-terminals.

In the liquid droplet jetting head of the present invention, the trapping groove may be formed in an area, of the covering layer, surrounding the individual supply-terminal group from the outer side thereof, the area being different from a portion of the covering layer in which the individual supply-terminals, the common supply-terminal, and the individual supply-wires are positioned. In this case, it is possible to prevent the liquid from entering up to the individual supply-terminals, the common supply-terminal, and the individual supply-wire, from the outside, and further, to prevent an electrical shorting (short-circuit) which causes a liquid droplet jetting defect affecting the drive.

In the liquid droplet jetting head of the present invention, the covering layer may include a first covering layer and a second covering layer, the first covering layer facing the substrate and the second covering layer being stacked on the first covering layer to face the piezoelectric unit, and the trapping groove may be formed in the second covering layer as a cutout which fully surrounds the individual supply-terminal group. In this case, since the first covering layer out of the two-layered covering layer, covers the individual supply-wire and the common supply-wire, it is possible to prevent each wire from being exposed. Moreover, since it is possible to form in the second layer, the trapping groove throughout the entire circumference surrounding the individual supply-terminal group, it is possible to prevent the entry of the liquid from four sides of the inkjet-head, thereby making it possible to prevent effectively the entry of the liquid.

In the liquid droplet jetting head of the present invention, a cutout which is open toward the trapping groove may be formed in the first covering layer at a position different from a portion of the first covering layer corresponding to the individual supply-wires. In this case, it is possible to increase practically a volume of the liquid which can be trapped due to the deep trapping groove, and to prevent the individual supply-wires from being exposed to the outside.

In the liquid droplet jetting head of the present invention, the opening may be formed to include a plurality of openings via which the individual supply-terminals are exposed respectively; and the trapping groove may be extended between the plurality of openings. In this case, even when the liquid has entered the inner side of the trapping groove surrounding the individual supply-terminal group, since it is possible to trap the liquid in the trapping groove extended between the individual supply-terminals which are partitioned (separated), the shorting (short-circuit) between the individual supply-terminals separated by the trapping groove hardly occurs.

According to a second aspect of the present invention, there is provided liquid droplet jetting head which jets droplets of a liquid, including:

a channel unit in which a liquid channel through which the liquid flows is formed;

a piezoelectric unit which is stacked on the channel unit, which has a drive electrode arranged on one surface of the piezoelectric unit, and which applies a jetting pressure to the liquid in the channel unit, based on a drive signal to the drive electrode; and a wiring unit which is stacked on the one surface of the piezoelectric unit, which has a sheet shaped substrate, a supply-terminal formed on a facing-surface of the substrate facing the piezoelectric unit to be connected with the drive electrode electrically, and an isolative covering layer which is stacked on the facing-surface of the substrate, which covers the supply-terminal, and in which an opening and an introducing groove are formed, a part of the supply-terminal being exposed via the opening toward the piezoelectric unit, and the introducing groove introducing a sealing agent to be applied in the introducing groove, wherein the introducing groove is open at an outer side along an outer peripheral edge of the piezoelectric unit and is formed between the wiring unit and the piezoelectric unit, which are facing mutually, as a cutout formed in the covering layer at a portion corresponding to the outer peripheral edge of the piezoelectric unit.

According to the second aspect of the present invention, since a cutout (notch) is formed in the portion corresponding to the outer peripheral edge of the piezoelectric unit in the covering layer, it is possible to infuse a sealing agent into the introducing groove (the sealing agent infusing groove) by using a capillary phenomenon. Therefore, a job of applying the sealing agent into the introducing groove becomes easy, and it is possible to seal the gap between the piezoelectric unit and the wiring unit to be liquid-tight. Moreover, the drive electrode and the supply-electrode which are electrically connected, being sealed by the sealing agent in the introducing groove corresponding to the outer peripheral edge, it is possible to prevent appropriately the entry of a liquid from the outside, and to prevent the electrical shorting (short-circuit).

In the liquid droplet jetting head of the present invention, the piezoelectric unit may have a plurality of drive portions which are driven by the drive signal applied to the drive electrode; and the drive electrode may have a plurality of individual drive electrodes which are connected to the drive portions respectively, and a common drive electrode which is connected commonly to the drive portions, and is arranged in the piezoelectric unit on an outer side of the individual drive electrodes;

the substrate of the wiring unit may have a first area which is arranged at one end side of the substrate and a second area which is extended from the first area to the other end side of the substrate, the first area may be connected to the piezoelectric unit, the supply-terminal may be provided in the first area, and the supply-terminal may include a plurality of individual supply-terminals corresponding to the individual drive electrodes and a common supply-terminal corresponding to the common drive electrode and arranged in the first area at an outer side of the individual supply-terminals; and the wiring unit may further have a plurality of individual supply-wires which are connected to the individual supply-terminals and which are extended to the second area, and a common supply-wire which is connected to the common supply-terminal and which is extended to the second area.

In this case, it is possible to drive the liquid droplet jetting head appropriately, and to prevent the entry of a liquid into the gap between the surfaces facing, of the piezoelectric unit and the wiring unit, thereby preventing the electrical shorting (short-circuit).

In the liquid droplet jetting head of the present invention, the introducing groove may be formed in an area, of the covering layer, along an outer peripheral edge of the piezoelectric unit, the area being different from a portion of the first area in which the individual supply-terminals, the common supply-terminal, and the individual supply-wires are formed. In this case, it is possible to prevent the liquid from outside entering the individual supply-terminals, the common supply-terminal, and the individual supply-wires, and further, to prevent the electrical shorting (short-circuit) which causes a defective jetting of liquid droplets.

In the liquid droplet jetting head of the present invention, the covering layer may include a first covering layer and a second covering layer, the first covering layer facing the substrate and the second covering layer being stacked on the first covering layer to face the piezoelectric unit, and the introducing groove may be formed as a cutout in the second covering layer at a portion corresponding to the outer peripheral edge of the piezoelectric unit. In this case, since the first layer out of the two-layered covering layer covers the individual supply-wires and the common supply-wire, it is possible to prevent each wire from being exposed, and to prevent the shorting of the wires by the liquid entering from outside. Moreover, since it is possible to form in the second layer, the introducing groove throughout the entire outer peripheral edge of the piezoelectric unit, it is possible to prevent assuredly the entry of the liquid from outside by sealing by the sealing agent from four sides.

In the liquid droplet jetting head of the present invention, a cutout which is open toward an outer side of the piezoelectric unit may be formed in an area of the first covering layer along the outer peripheral edge of the piezoelectric unit, and the area may be different from a portion, of the first covering layer, in which the individual supply-terminals, the common supply-terminal, and the individual supply-wire are positioned. In this case, since the first covering layer out of the two-layered covering layer covers the individual supply-wire, it is possible to prevent the shorting of wires by the liquid entering from outside. Moreover, since it is possible to hold (to accommodate) the sealing agent even in the cutout of the first covering layer, in addition to the introducing groove formed in the second covering layer, it is possible to seal more assuredly, the gap between the piezoelectric unit and the wiring unit.

In the liquid droplet jetting head of the present invention, a trapping groove may be formed in the covering layer at an inner side of the peripheral edge portion of the covering layer to surround the supply-terminal, and the trapping groove may be open toward the piezoelectric unit to trap a liquid which enters from outside of the piezoelectric unit.

In this case, since the trapping groove is formed in the covering layer, it is possible to prevent appropriately the shorting (short-circuit) between the individual drive electrodes of the piezoelectric unit, and the individual supply-terminals of the wiring unit, due to the liquid which has entered from outside.

Moreover, since the introducing groove is formed in the trapping groove, it is also possible to carry out easily and assuredly a job of applying the sealing agent, and to prevent the electrical shorting due to an ink leakage, by sealing appropriately the gap between the surfaces facing of the piezoelectric unit and the wiring unit.

DETAILED DESCRIPTION OF THE PREFERRED EMBODIMENTS

A liquid droplet jetting head according to an embodiment of the present invention will be described below with reference to the accompanying diagrams.

Figure 1A:
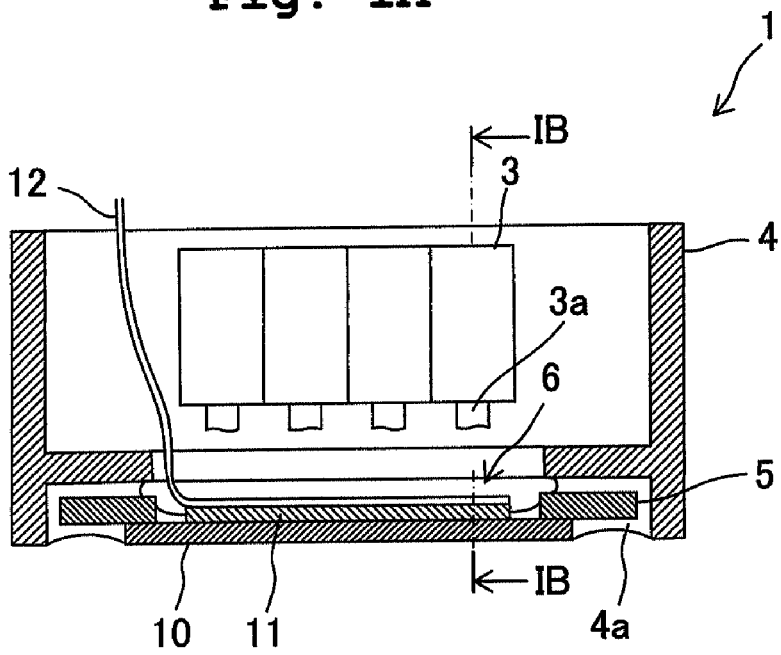
FIG. 1A and FIG. 1B are cross-sectional views of a carriage which includes a liquid droplet jetting head according to an embodiment, which is an example of an ink-jet printer head.
Figure 1B:
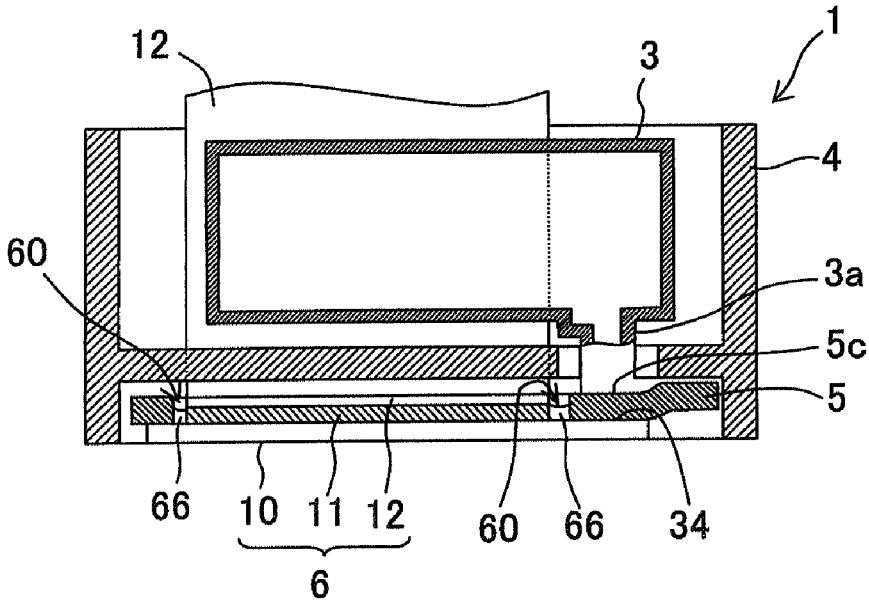

FIGS. 1A and 1B are diagrams showing a carriage on which the liquid droplet jetting head according to the embodiment is mounted. FIG. 1A shows a diagram when an ink-jet head is viewed from one side, and FIG. 1B shows a cross-sectional view of the ink-jet head taken along a IA-IA line in FIG. 1A. As shown in FIGS. 1A and 1B, the carriage 1 includes an ink tank 3 which supplies color inks such as cyan, magenta, yellow, and black to an after-mentioned channel unit 10 independently, a holder (holder case) 4 which accommodates and holds the ink tank 3, and an ink-jet head 6 which is installed on a lower portion of the holder 4 via a supporting plate (supporting frame) 5. Moreover, the ink-jet head 6 has the channel unit 10 having a plurality of stacked plates in which an ink channel (a liquid channel) 10*a* is formed (refer to FIG. 2), a piezoelectric unit 11 which is stacked on and adhered to an upper surface of the channel unit 10, and a wiring unit (chip on film (COF)) 12 which is connected to an upper surface of the piezoelectric unit 11.

A driver IC 51 which is a driving circuit is connected to the wiring unit 12 (refer to FIG. 3), and the driver IC 51 outputs a driving signal which selectively drives the piezoelectric unit 11 based on printing data from a printer or a computer connected to the printer. The carriage 1 including such ink-jet head 6 is movable parallel to a surface of a recording paper similarly as a known ink-jet printer. The ink-jet head 6 is capable of forming an image on the paper surface by jetting ink droplets while moving.

Figure 2:
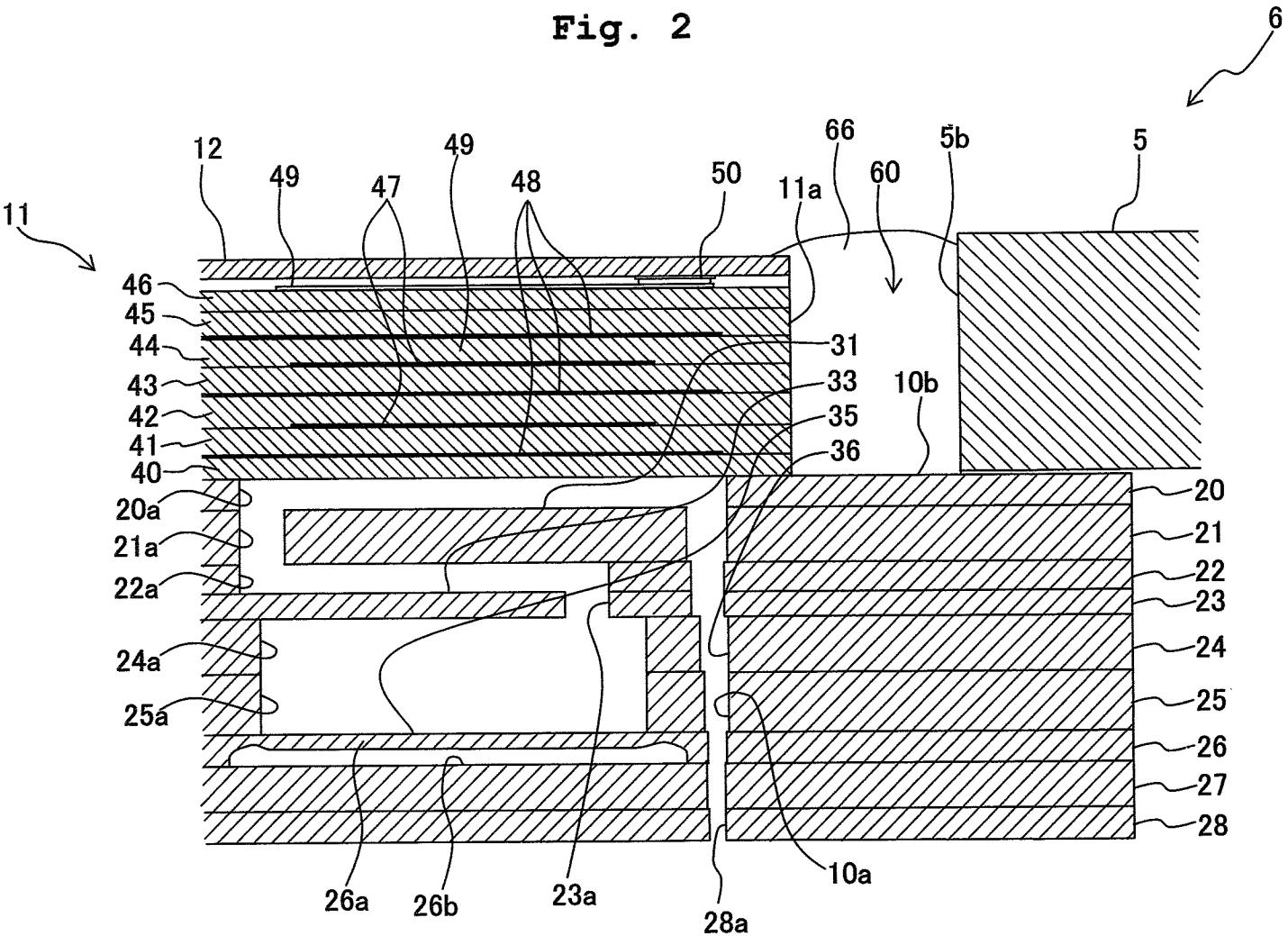
FIG. 2 is an enlarged cross-sectional view of an ink-jet head which includes the carriage shown in FIG. 1.
Figure 3:
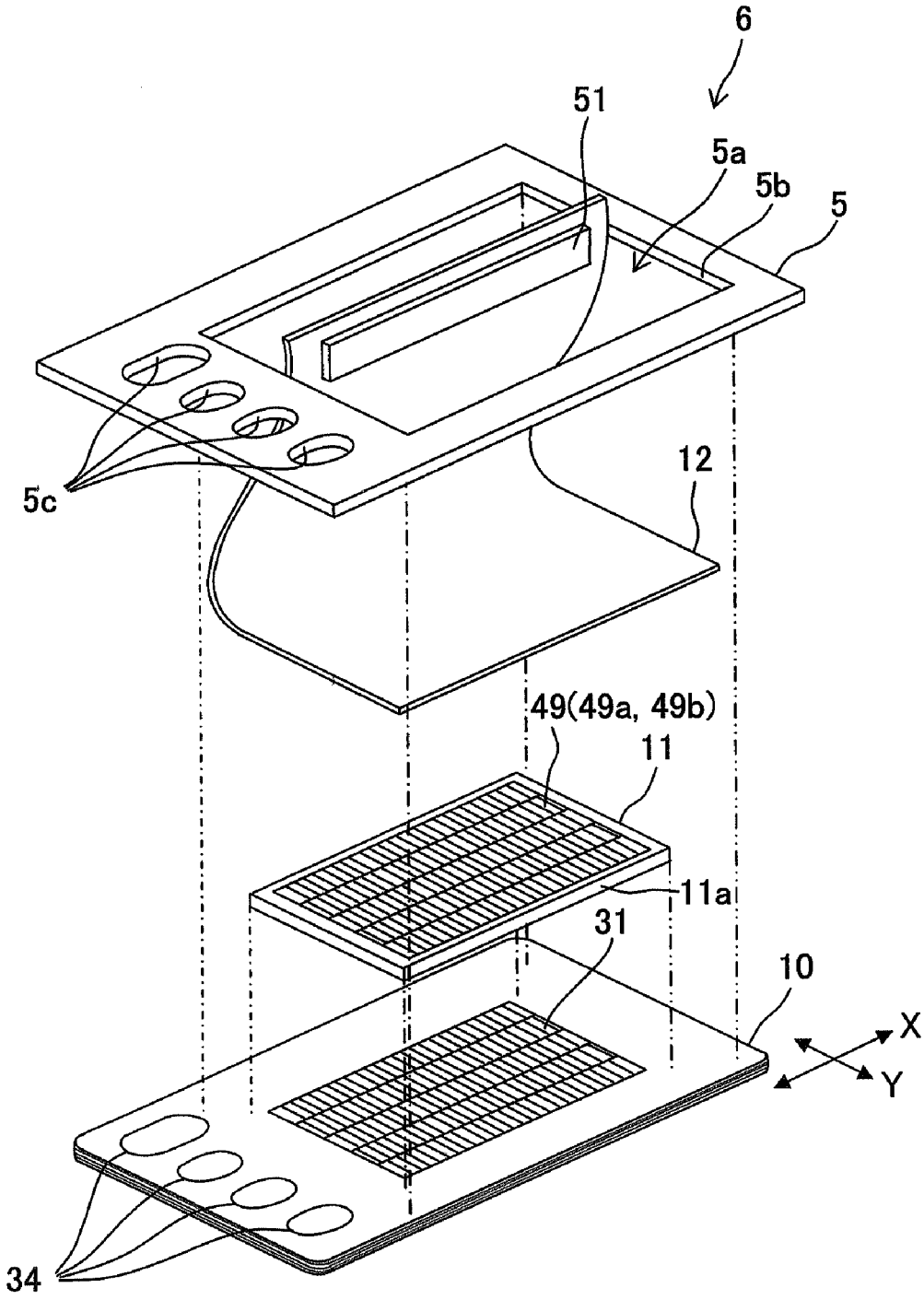
FIG. 3 is an exploded perspective view of an ink-jet head, showing a channel unit, a piezoelectric unit, a wiring unit, a thermally conductive plate material, and a supporting plate.

FIG. 2 is an enlarged cross-sectional view of the ink-jet head 6 which includes the carriage 1 shown in FIGS. 1A and 1B. FIG. 3 is an exploded perspective view of the ink-jet head 6, showing the channel unit 10, the piezoelectric unit 11, the wiring unit 12, and the supporting plate 5.

As shown in FIG. 2, the channel unit 10 of the ink-jet head 6 includes a pressure chamber plate 20, a first spacer plate 21, a throttle plate 22, a second spacer plate 23, a first common liquid chamber plate 24, a second common liquid chamber plate 25, a damper plate 26, a cover plate 27, and a nozzle plate 28, and these plates are stacked in this order from a top, and adhered mutually.

The nozzle plate 28 is made of a resin sheet of a material such as polyimide, and the remaining plates 21 to 27 are metal plates such as a 42% nickel alloy steel plate (42 alloy). Each of the plates 20 to 28 has a rectangular shape in a plan view, and has a thickness (in a range) of about 50 μm to 150 μm. In each of the plates 20 to 27, an opening or a recess which forms the ink channel 10*a* is formed by a method such as an electrolytic etching, a laser machining, and a plasma jet machining.

In the nozzle plate 28 which is at the lowermost layer of the channel unit 10, five nozzle rows arranged in a short-side direction (Y direction in FIG. 3) are formed. Each nozzle row is extended along a longitudinal direction (X direction in FIG. 3) of the nozzle plate 28. Each nozzle row has a large number of nozzle holes 28*a* for jetting the ink, having a fine (micro) diameter arranged at a minute (small) distance. Moreover, a plurality of pressure chamber holes 20*a* which forms a plurality of pressure chambers 31, is formed to penetrate through the pressure chamber plate 20 in a thickness direction thereof, the pressure chamber plate 20 being positioned at the uppermost layer of the channel unit 10. The pressure chamber holes 20*a* are formed corresponding to the nozzle holes 28*a*. In other words, five rows of the pressure chamber holes 20*a* arranged in Y direction are formed, and each row is extended in X direction. Each pressure chamber hole 20*a* is elongated (has a long and slender shape) in Y direction in a plan view, and is arranged with a longitudinal direction (Y axis direction) thereof along a direction (X direction) orthogonal to the row of the nozzle holes 28*a*. The piezoelectric actuator 11 is stacked on an upper side of these pressure chamber holes 20, and the first spacer plate 21 is stacked on a lower side. Accordingly, the plurality of pressure chambers 31 having an internal space is formed.

Through holes each of which forms a nozzle communicating channel 36 communicating from one end portion of one of the pressure chambers 31 up to one of the nozzle holes 28*a* is formed in the plates from the first spacer plate 21 to the cover plate 27. Moreover, grooves 22*a* and through holes 21*a* and 23*a* each of which forms a connecting channel 33 communicating with the one end portion of one of the pressure chambers 31 and the common ink chamber 35 are formed in the first spacer plate 21, the diaphragm plate 22, and the second spacer plate 23.

Moreover, common ink chamber holes 24*a* and 25*a* extending in the row direction of the pressure chambers 31 (X direction) are formed at lower side positions, of the two manifold plates 24 and 25, corresponding to positions at which the pressure chambers 31 are arranged in the row direction. The common ink chamber holes 24*a* and 25*a* which form the common ink chambers 35 are formed to penetrate in a thickness direction of each of the manifold plates 24 and 25, and five rows of the common ink chamber holes 24*a* and 25*a* are provided to be arranged in a direction (Y direction) in which the rows of the pressure chamber 31 are arranged. Moreover, five recesses are formed in a surface of the damper plate 26, not facing the common liquid chamber 35. A damper wall 26*a* at which a thickness of the damper plate 26 is thin is formed by these recesses. Five damper walls 26*a* are formed to be arranged in Y direction corresponding to a shape of the common liquid chamber 35. The second spacer plate 23, the two manifold plates 24 and 25, the damper plate 26, and the cover plate 27 are stacked in this order to form the common liquid chamber 35 and a damper space 26*b*. Furthermore, the nozzle plate 28 having the plurality of nozzle holes 28*a* is stacked on and adhered to the lower surface of the cover plate 27.

When these plates 20 to 28 are stacked, through holes and grooves which communicate mutually are formed, and the ink distribution channel 10*a* through which the ink is distributed is formed. In other words, each of the ink distribution channels 10*a* is formed by the common ink chamber 35, the connecting channel 33, the pressure chamber 31, a nozzle communicating channel 36, and the nozzle hole 28*a*. As a result of the structure (arrangement) described above, the ink supplied from the ink tank 3 into the channel unit 10 flows through the common ink chamber 35, the connecting channel 33, the pressure chamber 31, and the nozzle communicating channel 36, in this order, and is guided to the nozzle hole 28*a*.

Four ink supply ports 34 corresponding to inks of four colors are formed in the plates from the pressure chamber plate 20 to the manifold plate 25, at one end portion in a longitudinal direction of each plate (X direction) (refer to FIG. 3). Inks of four colors from the ink tank 3 are supplied independently to the ink supply ports 34 respectively. The ink supply port 24, through which the frequently used black ink flows in, are formed to be larger than the other ink supply ports 24, and is connected to one end portion in X direction of the two common liquid chambers 35. Accordingly, the ink supply port 34 of the black ink is connected to the two ink distribution channels 10*a*. Each of the other ink supply ports 34 communicates with one end portion in the X direction of one of the common liquid chambers 35 independently, and is connected to one of the remaining ink distribution channels 10*a*. In this manner, the channel unit 10 has five ink channels, and the ink-jet head 6 is structured to be capable of jetting inks of four types independently.

As shown in FIG. 1, when the ink-jet head 6 is attached to the holder 4 via the supporting plate 5, the ink supply ports 34 are connected to communicate with the ink connecting ports 5*c* of the supporting plate 5 and the ink outflow ports 3*a* of the ink tank 3 which is mounted on the holder 4 (refer to FIG. 1 and FIG. 3). On the other hand, as shown in FIG. 2, the piezoelectric unit 11 has a rectangular shape which is elongated in X direction in a plan view. Specifically, the piezoelectric unit has a plurality of stacked piezoelectric sheets 40, 41, 42, 43, 44, and 45 (40 to 45) each having a rectangular shape which is elongated in the X direction in a plan view, and a top sheet 46 having an insulating property. A thickness of the piezoelectric sheets 40 to 45 is approximately 30 μm, and the piezoelectric sheets 40 to 45 are formed of a ceramics material of lead zirconate titanate (PZT).

A plurality of individual electrodes 47 arranged in five rows, corresponding to positions of the pressure chambers 31 respectively, is formed on an upper surface of the even numbered piezoelectric sheets 41 and 43, which are the even numbered sheets among the piezoelectric sheets 40 to 45 from the lowermost piezoelectric sheet 40. The individual electrodes 47 are formed by printing to correspond with the rows of the pressure chambers 31 respectively. Moreover, on an upper surface of the odd numbered piezoelectric sheets 40, 42, and 44 from the lowermost piezoelectric sheet 40, a common electrode 48 arranged to cover all individual electrodes 47 in each row in a plan view, is formed by printing. The individual electrodes 47 and the common electrode 48 are electrically connected to the drive electrodes 49 (refer also to FIG. 3) provided on an upper surface of the top plate 46 via connecting wires (not shown) provided on a side surface of each of the piezoelectric sheets 40 to 45 and the top plate 46, or via connecting wires in the through holes (not shown). The common electrode 48 is grounded. The drive electrode 49 will be described later in detail. The individual electrodes 47, the common electrode 48, and the drive electrodes 49 are formed by screen printing by the Ag—Pd electroconductive material. Moreover, the piezoelectric unit 11 is smaller than the channel unit 10, and is arranged to expose the ink supply port 34 at the one end portion in the X direction of the channel unit 10. Moreover, the individual electrodes 47 of the piezoelectric unit 11 and the pressure chambers 31 of the channel unit 10 are joined upon stacking to be positioned face-to-face (facing positions) in a plan view.

One end portion of the wiring unit 12 is connected to the upper surface of the piezoelectric unit 11. The wiring unit 12 is a flexible wiring member in the form of a belt, and has a plurality of supply-terminals 50 corresponding to the drive electrodes 49 on the upper surface of the piezoelectric unit 11. Each of the supply-terminals 50 is electrically connected with an IC chip 51, which is provided to the other end portion of the wiring unit 12, by an electroconductive wire not shown in the diagram (refer to FIG. 3). Moreover, as it will be described later, solder bumps 52 are adhered to the supply-terminals 50, and the piezoelectric unit 11 and the wiring unit 12 stacked on the upper surface of the piezoelectric unit 11 are electrically connected to the supply-terminals 50 and the drive electrodes 49 via the solder bumps 52 which are melted (fused) by heating and pressurizing by a bar heater etc.

The ink-jet head 6 having such structure operates as described below, and jets ink droplets from the nozzle holes 28*a*. The ink is supplied from the ink outflow port 3*a* of the ink tank to the ink connecting port 5*c* of the supporting plate 5 and the ink supply port 34. A filter which is not shown in the diagram is installed on the ink supply port 34. The ink supplied through the ink supply port 34 to the channel unit 10 is filled in the liquid channel 10 formed by the common liquid chamber 35, a connecting channel 33, the pressure chamber 31, and the nozzle communicating channel 36. When the driver IC 51 selectively applies a driving electric potential to the piezoelectric unit 11 via the wiring unit 12 based on the printing data such that a predetermined electric potential is selectively applied to the individual electrodes 47, an electric potential difference is developed between the individual electrodes 47 to which the electric potential is applied, and the common electrode 48. Due to the electric potential difference developed, an electric field acts on an active portion of the piezoelectric sheets 41 to 44, and a deformation due to distortion occurs in a stacking direction of the sheets. Note that, the active portion means a portion of each of the piezoelectric sheets 41 to 44 sandwiched between the individual electrodes 47 and the common electrode 48, and specifically, the active portion means a portion in which the deformation due to distortion in the stacking direction as described above occurs. When the active portion is deformed in such manner, the piezoelectric sheets are projected toward an inside of the corresponding one of the pressure chambers 31. Therefore, a pressure inside the pressure chamber 31 is increased, and the liquid inside is jetted to outside from the nozzle hole 28*a* through the nozzle communicating channel 36.

Such ink-jet head 6 is supported by the holder 4 (refer to FIG. 1) by the rectangular-shaped supporting plate 5 as shown in FIG. 3. Concretely, the supporting plate 5 as shown in FIG. 3, is a plate member having a rectangular shape, in a plan view, larger than the channel unit 10, and has a shape of a frame in which a rectangular opening 5*a* is formed at a central portion thereof. Four ink connecting holes 5*c* arranged along Y direction are formed in one end portion in the longitudinal direction (X direction) of the supporting plate 5 to connect the ink outflow port 3*a* and the ink supply port 34. The opening 5*a* is formed to be slightly larger than the piezoelectric unit 11 in a plan view. The supporting plate 5 is fixed and adhered to an upper surface 10*a* of the channel unit 10 such that the piezoelectric unit 11 to which the one end portion of the wiring unit 12 is connected is positioned in the opening 5*a* of the supporting plate 5, and the other end portion of the wiring member 12 is drawn from the opening 5*a*.

At this time, a void passage 60 is formed between an inner peripheral portion 5*b* defining (forming) the opening 5*a* in the supporting plate 5, and an outer peripheral portion 11*a* of the piezoelectric unit 11. A bottom surface of the void passage 60 is an upper surface 10*b* of the channel unit 10. A liquid sealing agent 66 is filled in the void passage 60 (refer to FIG. 2), and a joining boundary (gap) defined by the supporting plate 5, the channel unit 10, and the piezoelectric unit 11 is sealed.

After the supporting plate 5 is adhered and fixed to the channel unit 10, the supporting plate 5 is fixed by an adhesive 4*a* to a bottom portion of the holder 4 (refer to FIG. 1A). The adhesive 4*a* is applied throughout the entire outer peripheral portion of the supporting plate 5, and a passage from a lower surface of the nozzle plate 28 (a surface on which the nozzle hole 28*a* opens toward an outer side) reaching the piezoelectric unit 11 via an outer side of the supporting plate 5 is closed by the adhesive 4*a*.

However, a step of infusing the sealing agent into the void passage 60 is a handling job, a quantity of the sealing agent to be applied may be fluctuated, a fluidity of the sealing agent may be varied, and the void passage 60 may be narrow. Therefore, infusing the sealing agent sufficiently in the void passage 60 surrounding the outer peripheral portion 11*a* becomes a troublesome and time consuming. Moreover, when a small gap between the connecting surfaces of the piezoelectric unit 11 and the wiring unit 12 which are connected by solder is not sealed sufficiently, the ink jetted from the nozzle hole 28*a*, the ink leaked from a passage ranging from the ink outflow port 3*a* of the ink tank 3 through the ink connecting port 5*c* to the ink supply port 34, the ink leaked at a boundary of joining of the channel unit 10 and the supporting plate 5, and/or the ink leaked at a boundary of the channel unit 11 and the supporting plate 5 might enter unexpectedly into the small gap between the connecting surfaces of the piezoelectric unit 11 and the wiring unit 12. When the ink enters this small gap, there is a possibility that the supply-terminals 50 or the drive electrode 49 are shorted, and the ink-jet head 6 cannot exhibit the desired liquid jetting characteristics. Therefore, in the ink-jet head according to the embodiment, the inkjet head is configured such that the ink is prevented from entering into such small connecting space (gap) between the piezoelectric unit 11 and the wiring unit 12, as described below. Or, the inkjet head is configured such that the short-circuit between the supply-terminals 50 and the drive electrodes 49 is prevented even when the ink has entered into the gap. Such structure (arrangement) will be described below.

First Embodiment

Figure 4:
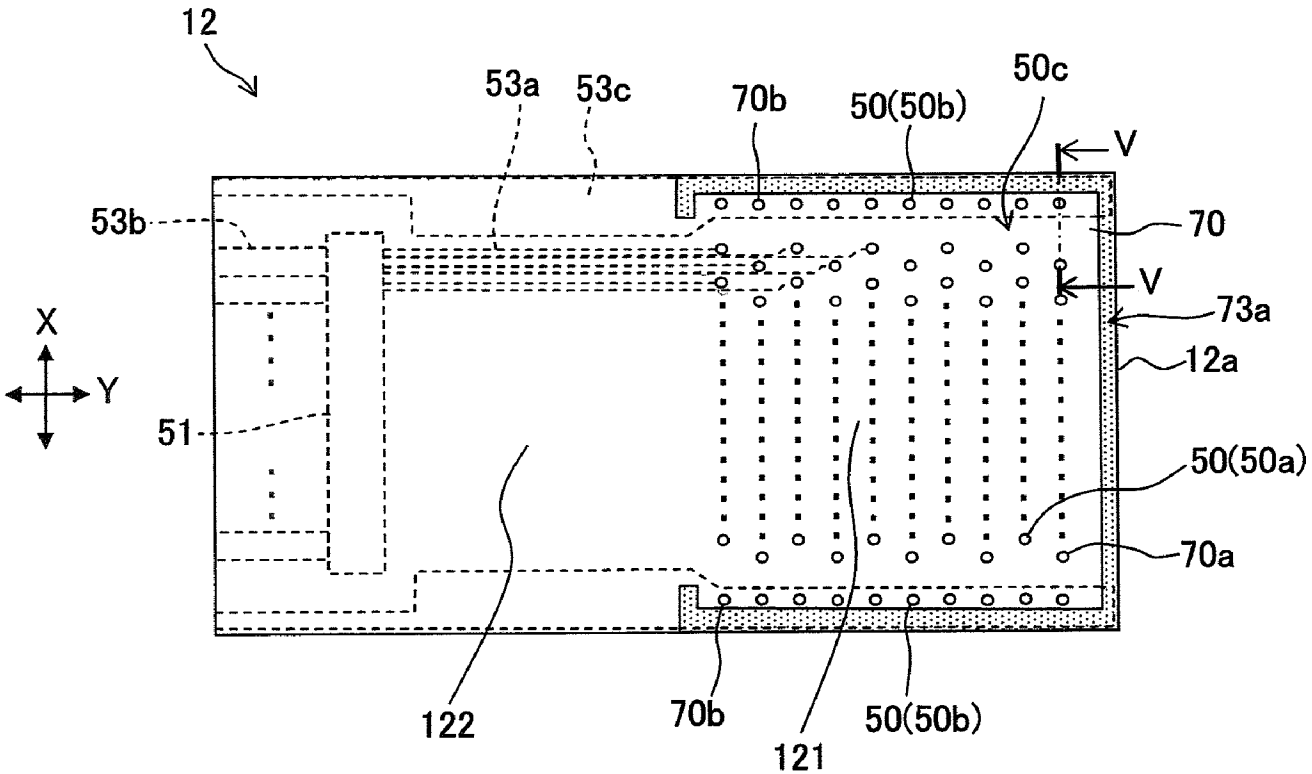
FIG. 4 is a plan view showing a structure (an arrangement) for preventing an entry of a liquid into a gap between the piezoelectric unit and the wiring unit, where, a structure of the wiring unit is shown from a rear-surface side (a surface side facing the piezoelectric unit)
Figure 5:
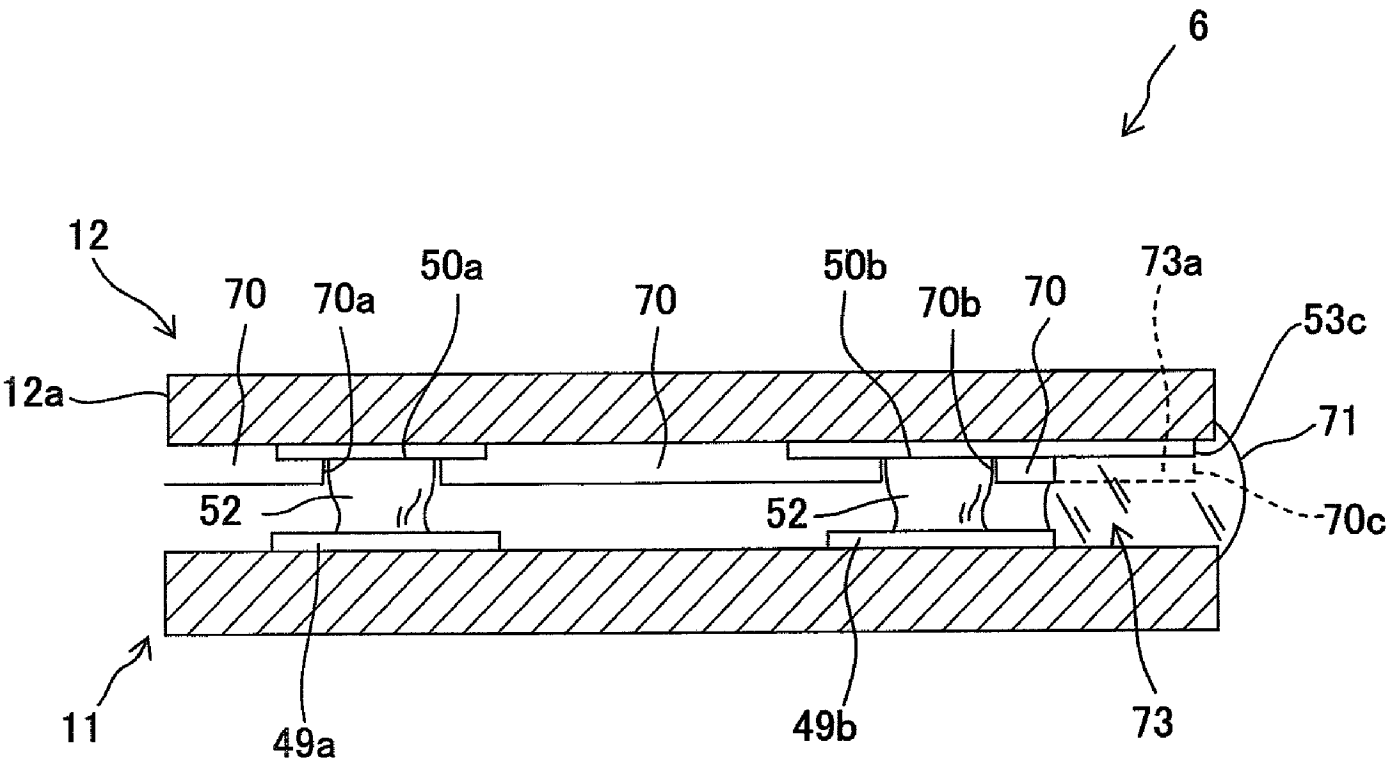
FIG. 5 is a partial cross-sectional view showing a state in which, the wiring unit shown in FIG. 4 is stacked on the piezoelectric unit.

FIG. 4 is a plan view showing the structure (arrangement) for preventing an entry of a liquid into the gap between the connecting surfaces of the piezoelectric unit 11 and the wiring unit 12. FIG. 4 shows a structure of the wiring unit 12 from a rear surface side (side of a surface facing the piezoelectric unit 11). FIG. 5 is a cross-sectional view taken along a line V-V in FIG. 4, showing the wiring unit 12 in FIG. 4 stacked on the piezoelectric unit 11.

As shown in FIG. 3, the plurality of drive electrodes 49 including a plurality of individual drive electrodes 49*a* and a common drive electrode 49*b* are formed on the upper surface of the piezoelectric unit 11 (upper surface of the top sheet 46 shown in FIG. 2). The individual drive electrodes 49*a* are arranged in five rows in Y direction corresponding to the pressure chamber rows, and each row of individual drive electrodes 49*a* is extended in X direction. The common drive electrode 49*b* is arranged to be extended in the form of a belt along the Y direction on both end sides of the X direction of the piezoelectric unit 11. The individual drive electrode 49*a* and the individual electrode 47 are electrically connected via a through hole (refer to FIG. 2), and moreover, the common drive electrode 49*b* and the common electrode 48 (refer to FIG. 2) are electrically connected via a through hole.

Next, a detailed structure of the wiring unit 12 will be described below. As shown in FIGS. 4 and 5, the wiring unit 12 has a sheet-shaped substrate 12*a* (having a thickness of 38 μm) in the form of a flexible belt. A layer of electroconductive wires including the supply-terminals (power supply terminals) 50 and an electroconductive wire 53 is provided on a rear-surface side (frontward side of a paper surface in FIG. 4) of the substrate 12. A covering layer 70 of a material such as polyimide or photosensitive solder resist is stacked to cover the layer of the electroconductive wire and the substrate 12. One end side of the sheet-shaped substrate 12*a* having a first area 121 is connected to the piezoelectric unit 11, and the other end side of the sheet-shaped substrate 12*a* having a second area 122 is extended in Y direction. The driver IC 51 (also refer to FIG. 3) is mounted on the second area 122.

The plurality of supply-terminals 50 is arranged on the first area 121 of the electroconductive wire layer, and the supply-terminals 50 include a plurality of individual supply-terminals 50*a* and a plurality of common supply-terminals 50*b*. The individual supply-terminals 50*a* form an individual supply-terminal group 50*c* provided at a position corresponding to the individual drive electrodes 49*a*. The individual supply-terminal group 50*c* includes ten rows of terminals provided at positions corresponding to the individual drive electrodes 49*a*, and each row of terminals is extended in X direction. Moreover, the plurality of common supply-terminals 50*b* is arranged at an appropriate distance along Y direction, at both end portions in a width direction (X direction) sandwiching the individual supply-terminal group 50*c* from both sides. Moreover, a plurality of output electroconductive wires 53*a* passing between the adjacent individual supply-terminals 50*a*, and connecting the individual supply-terminals 50*a* and the driver IC 51 of the second area 122 is drawn along the Y direction, and an input electroconductive wire 53*b* connecting the driver IC 51 of the second area 122 and a terminal provided at the other end side but not shown in the diagram is formed as a pattern on the sheet-shaped substrate 12. Moreover, at both ends of a width direction (X direction) of the wiring unit 12, a common electrode electroconductive wire 53*c* extended up to the other end portion along the Y direction is formed as a pattern in the form of a belt ranging from the first area 121 up to the second area 122. These layers of electroconductive wires are covered by the covering layer 70 having an insulating property. A part of the individual supply-terminals (the individual electrode terminals) 50*a* is exposed toward the piezoelectric unit 11 through an opening 70*a* which is formed by partially removing the covering layer 70 at a position corresponding to the individual supply-terminals 50*a* of the covering layer 70. Moreover, a part of the common electrode electroconductive wire 53*c* is exposed toward the piezoelectric unit 11 by through an opening 70*b* which is formed by partially removing the covering layer 70 covering the common electrode electroconductive wire 53*c* in the form of a belt which is wired, thereby forming the common supply-terminal (common electrode terminal) 50*b*. In other words, the common supply-terminal 50*b* is formed by the part of the common electrode electroconductive wire 53*c*.

A solder bump is formed at an exposed portion, facing the piezoelectric unit 11, of the individual supply-terminal 50*a* and the common supply-terminal 50*b*. The wiring unit 12 are stacked on the piezoelectric unit 11, and each of the supply terminals 50 and each of the drive electrodes 49 are joined by melting (fusing) the solder by pressurizing and heating with a bar heater from the upper surface of the wiring unit 12 such that each of the supply-terminals 50 are positioned to correspond to one of the drive electrodes 49.

In a case of the ink-jet head 6 according to the embodiment, a sealing agent 71 in a liquid form is applied to a gap between the joining surfaces at the outermost peripheral portion of the piezoelectric unit 11 and the wiring unit 12 (with the gap opened to the outside), and by hardening the sealing agent which has entered the gap, the gap is sealed to be liquid-tight from an outside. The sealing agent 71 is made to be susceptible to enter into the gap at the outermost peripheral portion opened to the outside, and the opening is sealed assuredly.

In other words, as shown in FIG. 4, in the covering layer 70 which covers the lower surface of the sheet-shaped substrate 12*a*, a peripheral portion corresponding to substantially three sides in the outer (outermost) peripheral portion 11*a* of the rectangular shaped piezoelectric unit 11 is removed (a cutout (notch) 73*a*), the three sides excluding a side toward which the other end side of the wiring unit 12 is drawn (side in Y direction in FIG. 4) when the wiring unit 12 is stacked on and adhered to the piezoelectric unit 11. As shown in FIG. 5, in a cross-sectional view, the common electrode electroconductive wire 53*c* which is the peripheral portion or the sheet-shaped substrate 12*a* are exposed toward the piezoelectric unit 11. The gap (space) formed between the connecting surface of the piezoelectric unit 11 and the connecting surface of the wiring unit 12 is expanded, and a sealing agent infusing groove (an introducing groove) 73 which opens toward outside is formed.

Since the sealing agent infusing groove 73 is formed, a space into which the sealing agent 71 enters is wide in the cutout 73*a*. Therefore, when the sealing agent in the liquid form is applied, the sealing agent 71 can enter easily, and a job of applying the sealing agent 71 in the liquid form along the sealing agent infusing groove 73 becomes easy. In other words, since the piezoelectric unit 11 and the wiring unit 12 are joined by being pressurized and heated by the bar heater, a distance between the joining surfaces being extremely narrow in general. Therefore, it is difficult to seal assuredly this narrow gap by applying the sealing agent 71. However, since an entrance portion (in other words, the sealing agent infusing groove 73) of the gap is slightly widened due to the cutout 73*a*, the job of applying the sealing agent 71 becomes easy. Moreover, since the sealing agent 71 which has been applied is infused along (through) the sealing agent infusing groove 73 due to a capillary phenomenon, the job of applying the sealing agent 71 becomes easy and a sealing effect is also improved.

The cutout 73*a* as shown in FIG. 4 is formed on the peripheral side corresponding to the substantially three sides excluding the side toward which the other end side of the wiring unit 12 is drawn. This is because, the plurality of output electroconductive wires (individual electrode electroconductive wires) 53*a* which output a signal for driving the piezoelectric unit 11 are wired. Accordingly, the output electroconductive wires 53*a* are prevented from being exposed, and not let to be formed at positions at which the individual supply-terminal 50*a* and the common supply-terminal 50*b* are arranged. This is for preventing a defective mechanical connection, a defective electrical connection and a short-circuit due to the sealing agent. In FIG. 5, a part of the common electrode electroconductive wire 53*c* is exposed by the cutout. However, since the common electrode electroconductive wire 53*c* is connected to the ground, there is no electrical effect. Therefore, it is possible to provide the cutout 73*c* at a position at which the common electrode electroconductive wire 53*c* is formed broadly as shown in FIG. 4, and an area on which the sealing agent 71 is applied is widened.

The individual supply-terminals 50*a*, an electrode plate 50*d*, and the electroconductive wires 53 are arranged on a lower surface of the sheet-shaped substrate 12*a*, and the covering layer 70 is stacked to cover the individual supply-terminals 50*a*, the electrode plate 50*d*, and the electroconductive wire 53. Moreover, at the time of forming the openings 70*a* and 70*b* by a hitherto known method such as a photoresist, an etching, and a laser machining, in a portion of the covering layer 70, corresponding to the individual supply-terminals 50*a* and the common supply-terminal 50*b*, the cutout 73*a* is formed by removing also the outermost peripheral portion 70*c* (portion shown by broken lines in FIG. 5) of the covering layer 70. The cutout 73*a* is formed by removing the covering layer 70, and exposing the common electrode electroconductive wire 53*c* and the sheet-shaped substrate 12*a*. Here, when processing (machining) is possible, the cutout 73*a* may also be formed as a recess opened toward the piezoelectric unit 11. When it is possible to form a recess, since an area in which the output electroconductive wire (individual electrode electroconductive wire) 53*a* drawn is not exposed, it is possible to form a cutout in the entire peripheral portion facing four sides of an external shape (outer four sides) of the piezoelectric unit 11, and to infuse the sealing agent, and to prevent the entry of ink from the four sides.

Second Embodiment

Figure 6:
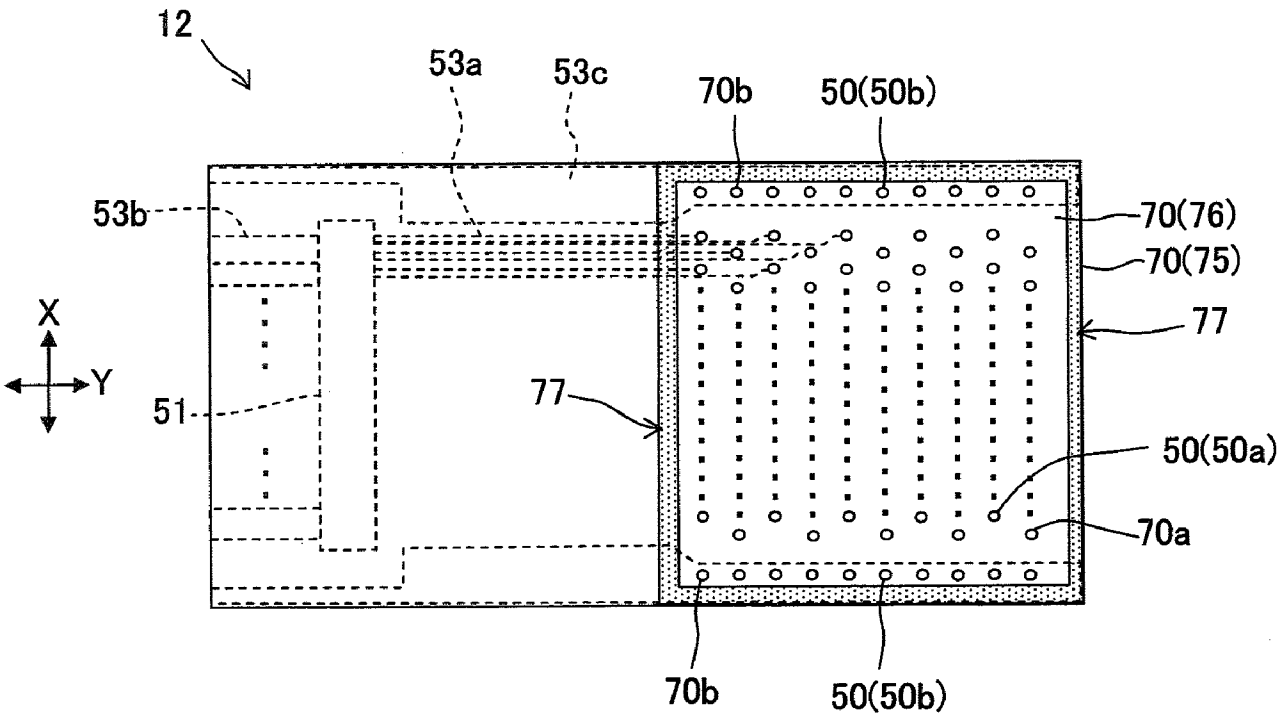
FIG. 6 is a plan view showing another structure (arrangement) for preventing the entry of a liquid into the gap between the piezoelectric unit and the wiring unit, where, a structure of the wiring unit is shown from the rear-surface side.
Figure 7:
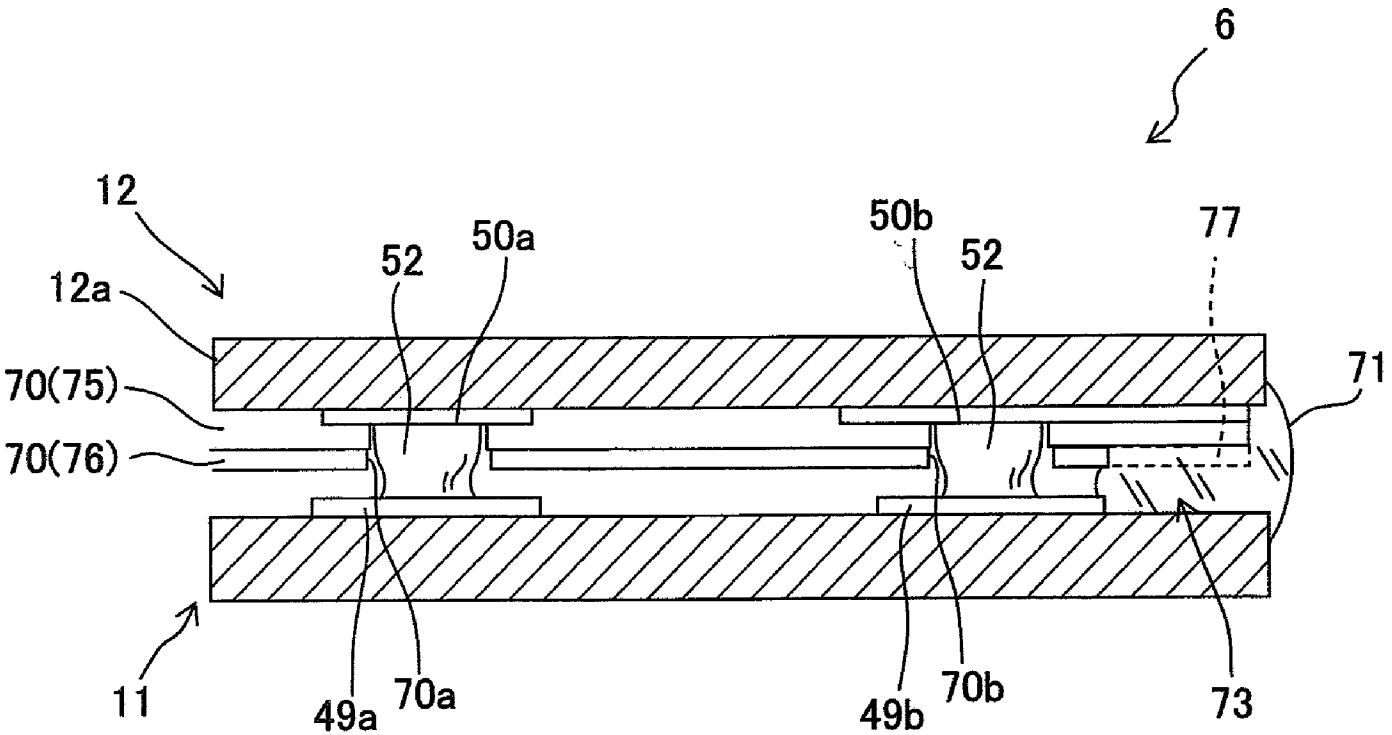
FIG. 7 is a partial cross-sectional view showing a state in which, the wiring unit shown in FIG. 8 is stacked on the piezoelectric unit.

FIG. 6 is a plan view showing another structure (arrangement) for preventing the entry of a liquid into the gap between the piezoelectric unit 11 and the wiring unit 12, and shows the structure of the wiring unit 12 from the rear surface side (side of a surface facing the piezoelectric unit 11). FIG. 7 is a partial cross-sectional view in which the wiring unit 12 shown in FIG. 6 is stacked on the piezoelectric unit 11.

The wiring unit 12 according to the second embodiment differs from the wiring unit 12 according to the first embodiment at the following two points. The first point is that, the covering layer 70 which covers the lower surface of the sheet-shaped substrate 12*a* has a two-layered structure of a first covering layer 75 and a second covering layer 76. The second point is that, the sealing agent infusing groove 73 is formed to be extended over the entire periphery surrounding the individual supply-terminal 50*a* and the common supply-terminal 50*b*. Consequently, these two points of difference will be described below in detail and the rest of the structure being similar to the structure which has already been described, same reference numerals are assigned to the corresponding portions (components), and the description of these components is omitted.

As shown in FIGS. 6 and 7, the covering layer 70 includes the first covering layer 75 which is adhered upon stacking to cover the electroconductive layer and to cover the entire wide surface of the sheet-shaped substrate 12*a*, and the second covering layer 76 which has an area almost same as the outer shape of the piezoelectric unit 11, and which is adhered upon stacking on the first covering layer 75. The openings 70*a* which expose the individual supply-terminals 50*a*, and the opening 70*b* which exposes the common supply-terminal 50*b* are formed in the first covering layer 75 and the second covering layer 76 respectively. A cutout 77 which forms the sealing agent infusing groove 73 is formed in a surface of the second covering layer 76 facing the piezoelectric unit 11. The cutout 77 has a rectangular shape corresponding to the entire periphery of the outermost peripheral portion of the piezoelectric unit 11 (four sides of the piezoelectric unit 11), and the individual supply-terminal 50*a* and the common supply-terminal 50*b* are surrounded by the cutout 77. As shown in FIG. 7, since the cutout 77 is not formed in the first covering layer 75, the first covering layer 75 which covers the entire periphery along the outermost peripheral portion in a cross-sectional view in FIG. 7 is exposed toward the piezoelectric unit 11. Since the first covering layer 75 covers the output electroconductive wires 53*a*, it is possible to provide the cutout 77 in the second covering layer 75 corresponding to the four sides of the piezoelectric unit 11.

According to the ink-jet head 6 of the second embodiment, since sealing agent infusing groove 73 is formed throughout the entire periphery surrounding the individual supply-terminals 50*a* and the common supply-terminal 50*b*, it is possible to seal the individual supply-terminals 50*a* and the common supply-terminal 50*b* over the entire surrounding periphery. Consequently, it is possible to prevent effectively the entry of the liquid. The ink-jet head according to the second embodiment can function and effect as similar to the ink-jet head according to the first embodiment. Moreover, the cutout 77 may be formed as a recess as in the first embodiment.

Third Embodiment

Figure 8:
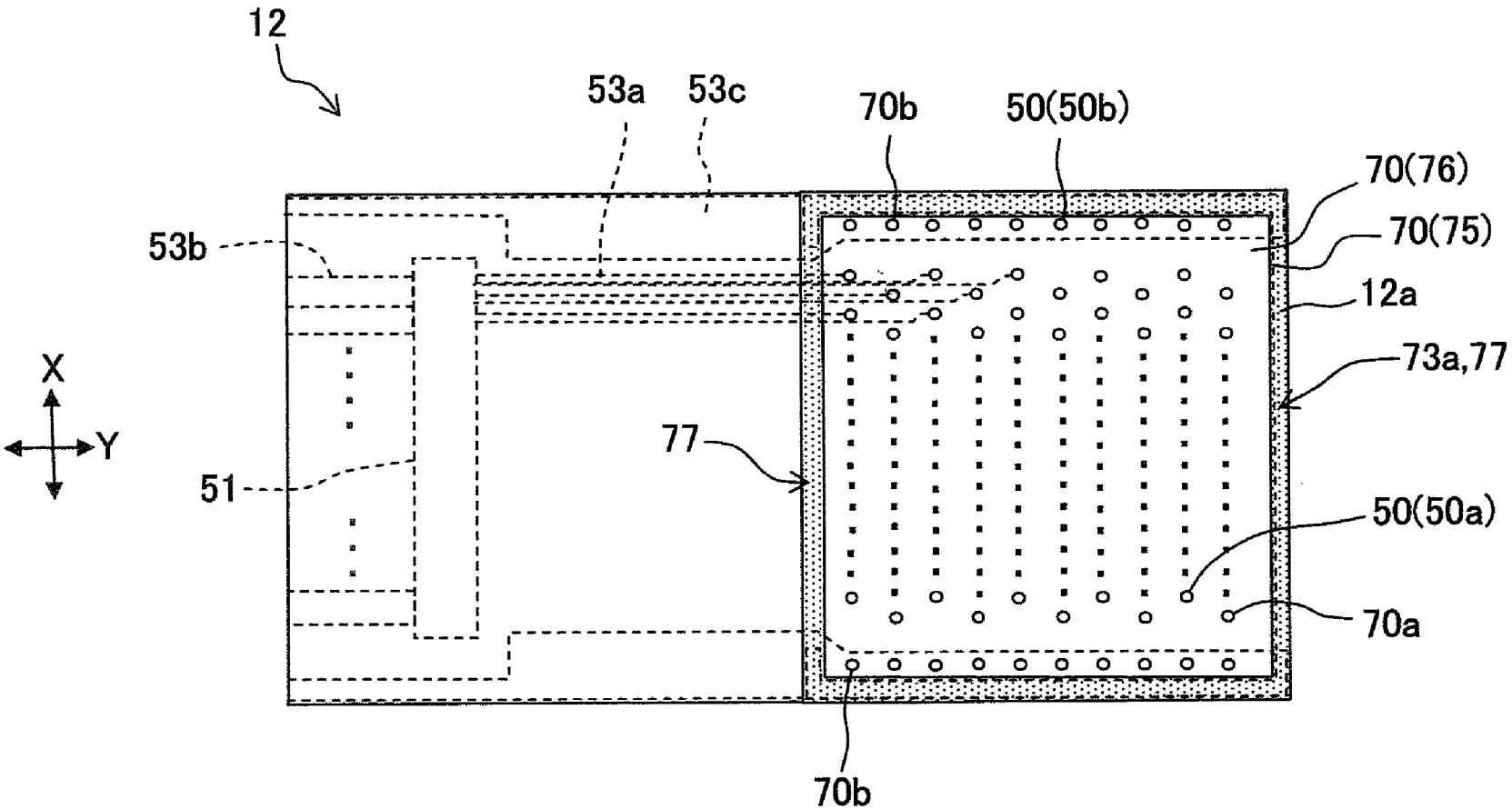
FIG. 8 is a plan view showing another structure (arrangement) for preventing the entry of the liquid into the gap between the piezoelectric unit and the wiring unit.
Figure 9:
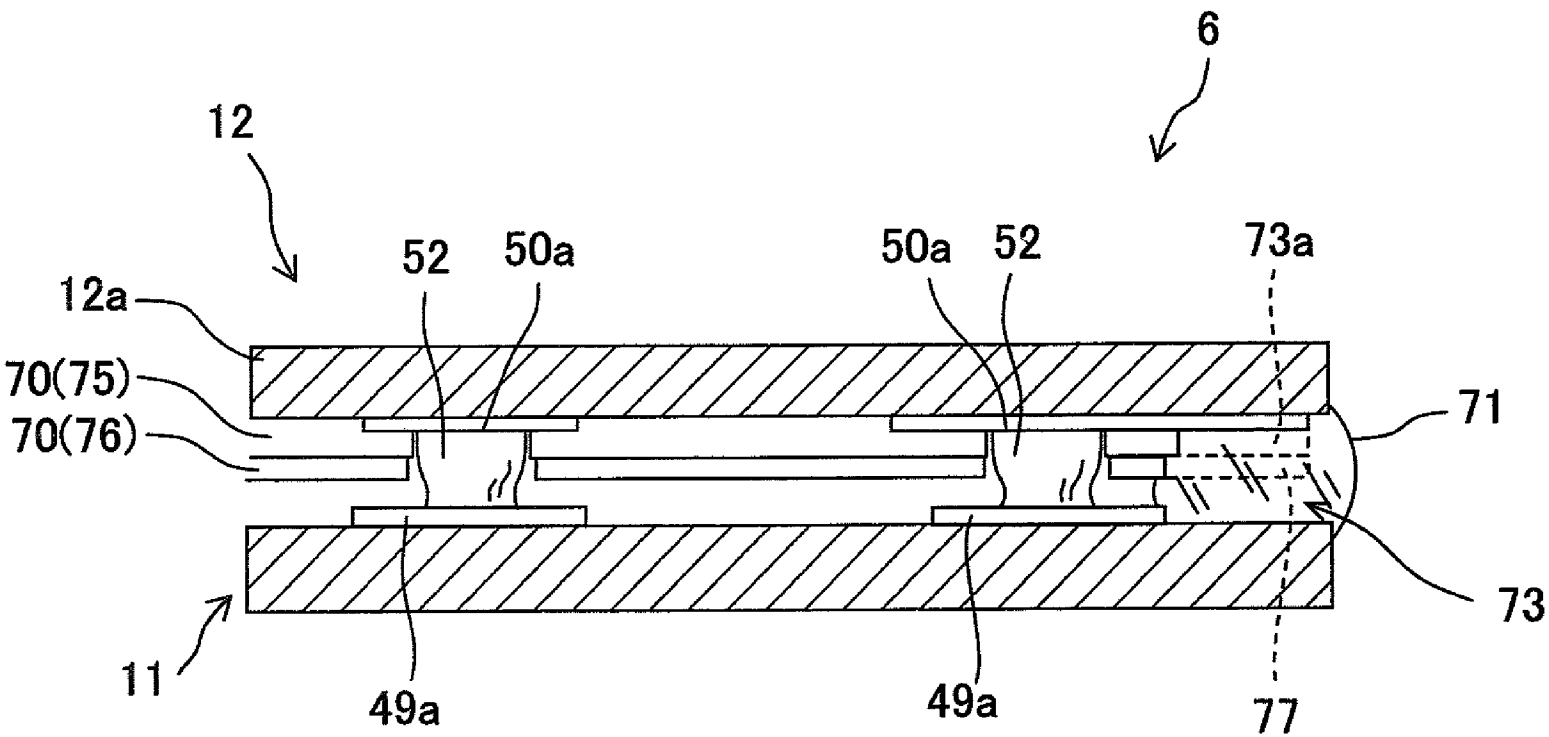
FIG. 9 is a partial cross-sectional view showing a state in which, the wiring unit shown in FIG. 8 is stacked on the piezoelectric unit.

FIG. 8 is a plan view showing another structure for preventing the entry of a liquid into the gap between the piezoelectric unit 11 and the wiring unit 12, and shows the structure of the wiring unit 12 viewing from the rear surface side (side of the surface facing the piezoelectric unit 11). FIG. 9 is a partial cross-sectional view of the wiring unit 12 shown in FIG. 8 stacked on the piezoelectric unit 11. The wiring unit 12 according to the third embodiment has a structure in which the structure according to the first embodiment and the structure according to the second embodiment are combined.

In other words, as shown in FIGS. 8 and 9, the wiring unit 12 includes the covering layer 70 having a two-layered structure including the first covering layer 75 and the second covering layer 76. The cutout 77 which is extended over the entire periphery surrounding the individual supply-terminals 50*a* and the common supply-terminal 50*b* similarly as in the second embodiment is formed in the second covering layer 76, and a cutout 73*a* is formed in the first covering layer 75 to surround the outside of the individual supply-terminals 50*a* and the common supply-terminals 50*b* except a portion corresponding to a position at which the output electroconductive wires 53*a* are arranged, similarly as in the first embodiment. Moreover, in a plan view, the cutout 73*a* of the first covering layer 75 is formed to be overlapping with the cutout 77 of the second covering layer 76, and the sheet-shaped substrate 12*a* is exposed toward the piezoelectric unit 11 in this overlapping portion.

An action and an effect obtained by the ink-jet head 6 according to the third embodiment are similar to those obtained by the inkjet head according to the first embodiment and the second embodiment, and it is possible to prevent effectively the entry of a liquid by sealing to be liquid-tight the individual supply-terminal 50*a* and the common supply-terminal 50*b* throughout the entire periphery. Furthermore, since the cutouts 73*a* and 77 are provided to both of the first covering layer 75 and the second covering layer 76, an area of opening to the outside of the sealing agent infusing groove 73 becomes large (increases), and the job of applying the sealing agent 71 becomes easy. The cutout 73*a*, similarly as mentioned in the first embodiment, may be formed as a recess.

In the first to third embodiments, the sealing agent 70 is applied in the gap between the connecting surface of the wiring unit 11 and the connecting surface of the piezoelectric unit 12. As it has been described above, the ink-jet head 6 is installed on the supporting plate 5, and the liquid sealing agent 66 is filled in a rectangular-shaped void passage 60 formed between the inner peripheral portion 5*b* of the opening 5*a*, and the outer peripheral portion 11*a* of the piezoelectric unit 11 (refer to FIG. 2). When the ink-jet head 6 has a structure as described in the first to third embodiments, the liquid sealing agent 66 to be filled in the void passage 60 is susceptible to be infused into the sealing agent infusing groove 73, and it is easy to seal the gap between the connecting surfaces of the piezoelectric unit 11 and the wiring unit 12, and it is possible to prevent the unexpected entry of ink.

Fourth Embodiment

In the ink-jet head 6 according to a fourth embodiment, unlike the ink-jet heads 6 in the first to third embodiments, an attempt is made to trap the ink which has entered from the outside of the ink-jet head 6 before reaching the individual supply-terminal 50*b*, and for trapping the ink, a trap groove 80 is formed. Such structure will be described below with reference to FIGS. 10 and 11.

Figure 10:
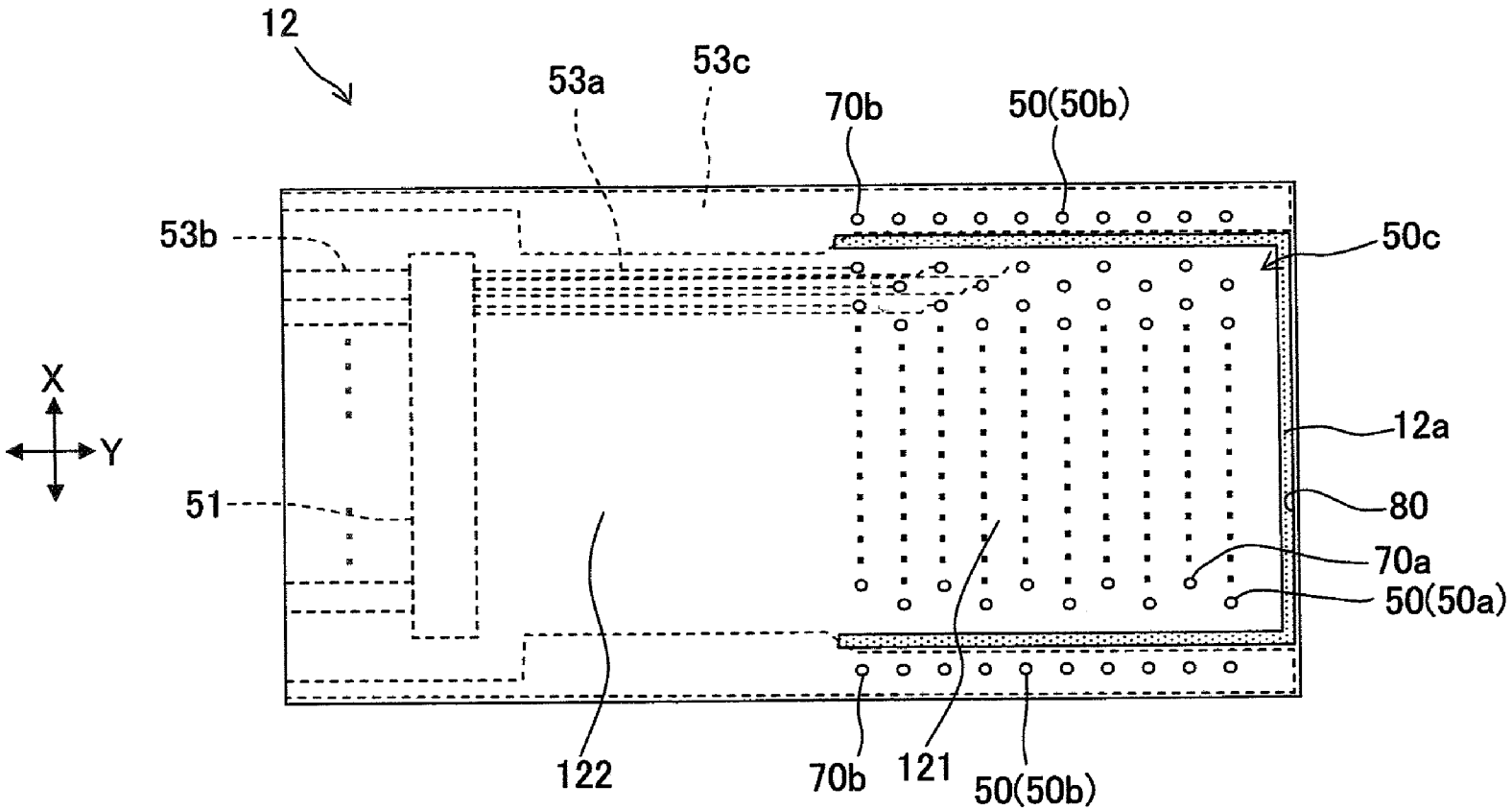
FIG. 10 is a plan view showing a structure (an arrangement) for trapping (capturing) the liquid which has entered into the gap between the piezoelectric unit and the wiring unit, where, the structure of the wiring unit is shown from the rear-surface side.
Figure 11:
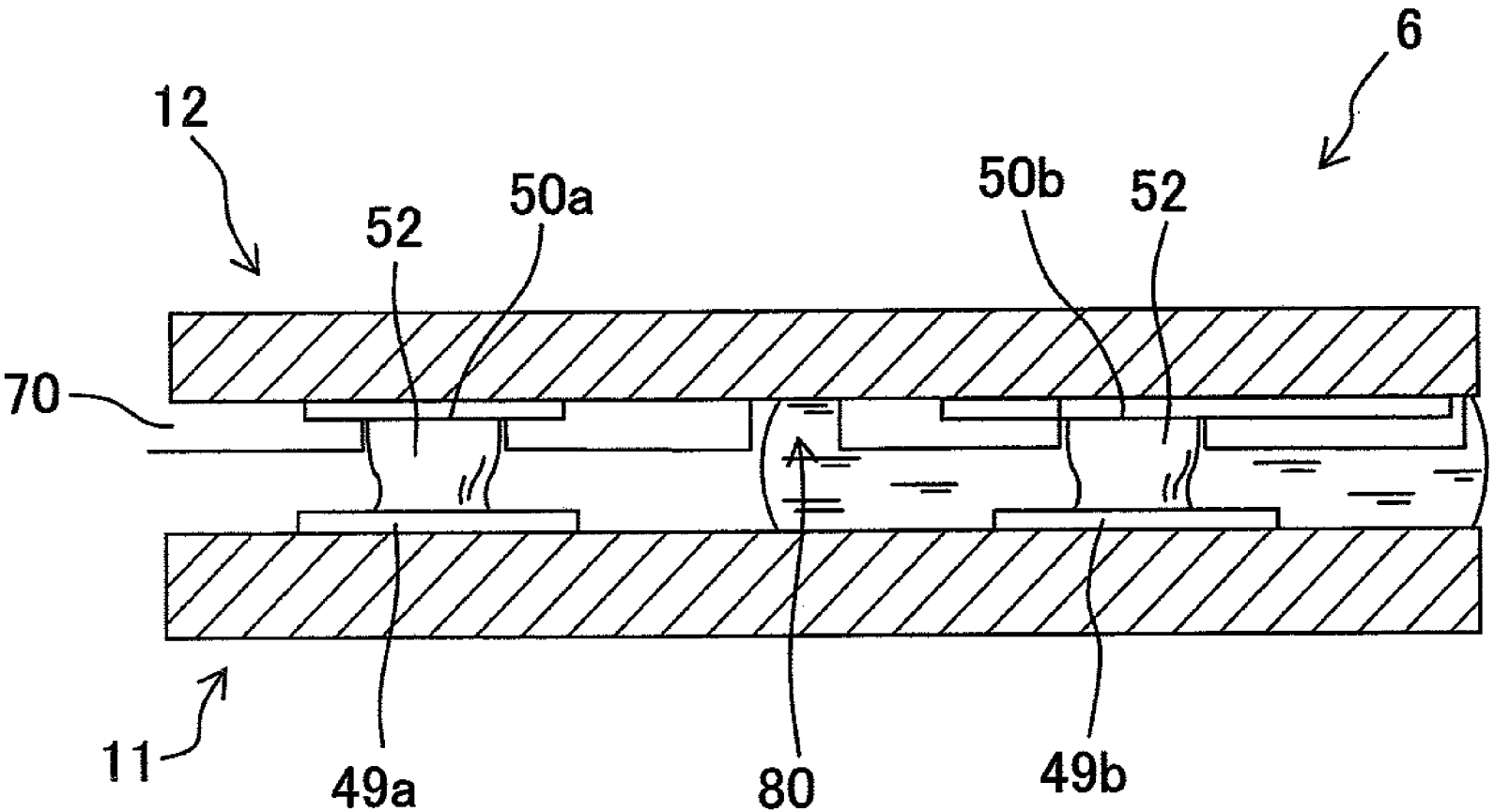
FIG. 11 is a partial cross-sectional view showing a state in which, the wiring unit shown in FIG. 10 is stacked on the piezoelectric unit.

FIG. 10 is a plan view showing a structure for trapping the ink which has entered the gap between the connecting surfaces of the piezoelectric unit 11 and the wiring unit 12, and the structure of the wiring unit 12 is shown as viewed from the rear surface side (side of the surface facing the piezoelectric unit 11). FIG. 11 is a partial cross-sectional view showing the wiring unit 12 shown in FIG. 10 stacked on the piezoelectric unit 11.

As shown in FIGS. 10 11, in the wiring unit 12, the common supply-terminal 50*b* is arranged to sandwich the individual supply-terminal 50*c* from both sides similarly as in the first example, and the covering layer 70 having a one-layered structure is stacked on the lower surface of the sheet-shaped substrate 12*a*. Moreover, the trapping groove 80 having a substantial U-shape is formed to be opening downward (toward the piezoelectric unit 11) in this covering layer 70, at a position on an inner side of an outermost peripheral portion of the piezoelectric unit 11, such that the trapping groove 80 surrounds the individual supply-terminal group 50*c*. More elaborately, the trap groove 80 has a U-shaped cross section, extended straight in the X direction, on an inner side of one end side of the wiring unit 12, and both ends of the trapping groove 80 are extended in Y direction, passing through the individual supply-terminal 50*c* and the common supply-terminal 50*b*. The trapping groove 80 is not formed in a portion, of the covering layer 70, corresponding to a position at which the output electroconductive wires 53*a* are arranged, therefore the output electroconductive wires 53*a* are not exposed to outside of the wiring unit 12.

According to the ink-jet head 6 of the fourth embodiment, even when the ink has entered the gap between the connecting surfaces of the piezoelectric unit 11 and the wiring unit 12 as shown in FIG. 11, the ink is trapped in the trapping groove 80, and it is possible to prevent the ink from reaching the individual supply-terminals 50*a* (and the individual drive electrodes 49*a*).

Even when the common drive electrode 49*b* and the common supply-terminal 49*a* make a contact with the ink, a problem such as that of shorting (short-circuit) does not occur. Moreover, in the structure according to the fourth embodiment, the trapping groove 80 is arranged at an inner side of the common supply-terminal 49*b* (a position near the individual supply-terminal 49*a*). By making such an arrangement, it is possible to reduce an amount of liquid which reaches the trapping groove 80, out of the liquid which enters inside from the gap between the piezoelectric unit 11 and the wiring unit 12. Consequently, it is possible to trap assuredly in the trapping groove 80 the reduced liquid.

Moreover, when the substantially U-shaped trapping groove 80 along the outermost periphery is formed at a position of the piezoelectric unit 11, on the inner side of the outermost peripheral portion (side of the individual supply-terminal group 50*c*), the ink is trapped in the trapping groove 80, and it is possible to prevent the entry of ink to the individual supply-terminal group 50*c*. Moreover, the trapping groove 80 may be formed as a recess similarly as described in the first embodiment.

Fifth Embodiment

Figure 12:
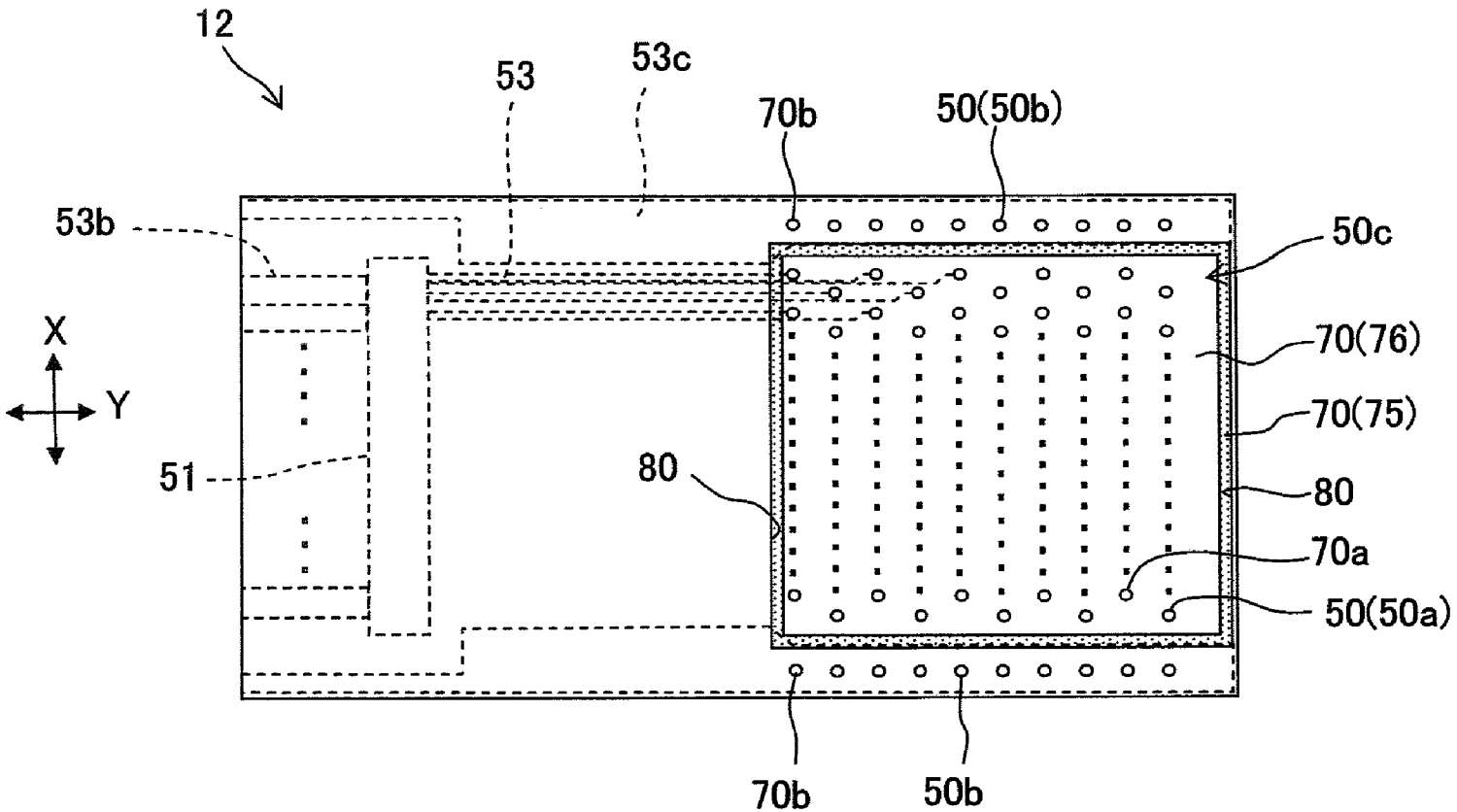
FIG. 12 is a plan view showing another structure (arrangement) for trapping the liquid which has entered into the gap between the piezoelectric unit and the wiring unit.
Figure 13:
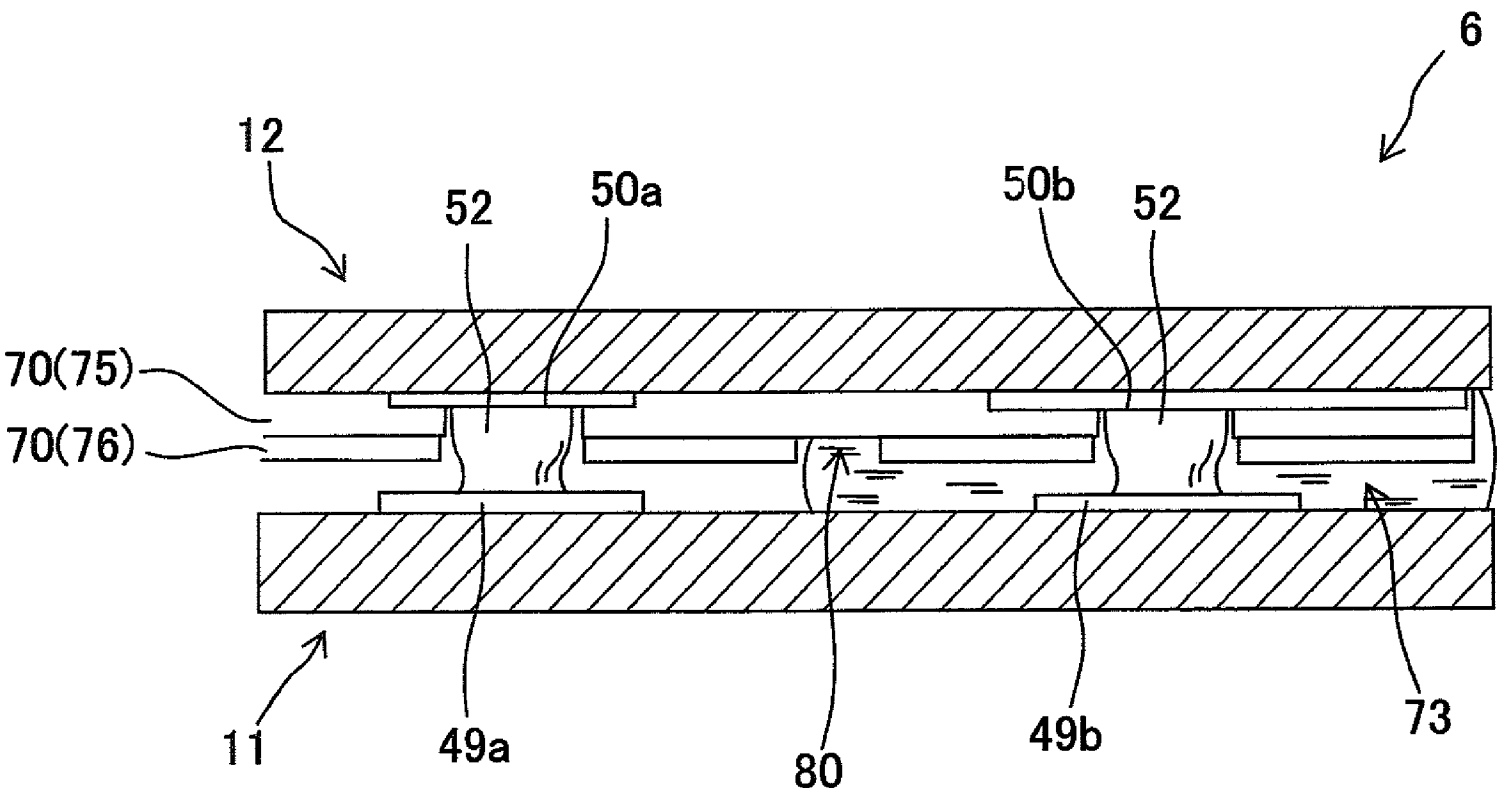
FIG. 13 is a partial cross-sectional view showing a state in which, the wiring unit shown in FIG. 12 is stacked on the piezoelectric unit.

FIG. 12 is a plan view showing another structure (arrangement) for trapping the liquid which has entered into the gap between the connecting surfaces of the piezoelectric unit 11 and the wiring unit 12, and shows the structure of the wiring unit 12 viewed from the rear surface side (side of the surface facing the piezoelectric unit 11). FIG. 13 is a partial cross-sectional view showing that the wiring unit 12 shown in FIG. 12 is stacked on the piezoelectric unit 11.

The wiring unit 12 according to the fifth embodiment differs from the wiring unit 12 according to the fourth embodiment at a point that, the covering layer 70 which covers the lower surface of the sheet-form substrate 12*a* has a two-layered structure of the first covering layer 75 and the second covering layer 76, and a point that the trapping groove 80 is formed over the entire periphery surrounding the individual supply-terminal group 50*c*. Consequently, these two points of difference will be described below in detail and the rest of the structure being similar to the structure which has already been described, same reference numerals are assigned to the corresponding portions (components), and the description of these components is omitted.

As shown in FIGS. 12 and 13, the covering layer 70 includes the first covering layer 75 and the second covering layer 76 which is stacked on and adhered to the first covering layer 75 similarly as the structure according to the second embodiment. The openings 70*a* which expose the individual supply-terminals 50*a* and the openings 70*b* which expose the common supply-terminals 50*b* are formed in the first covering layer 75 and the second covering layer 76 respectively. The trapping groove 80 which is cut only in the second covering layer 76 is formed at a position surrounding the individual supply-terminal group 50*c*, and a cutout is not formed (not cut) in the first covering layer 75.

Moreover, the trapping groove 80 formed in the second covering layer 76 is formed to be substantially rectangular-shaped surrounding the entire periphery of the individual supply-terminal group 50*c* and passing between the common supply-terminals 50*b* and the individual supply-terminal group 50*c*. Consequently, the trapping groove 80 is also formed in a portion of the second covering layer 76 corresponding to a portion in which the output electroconductive wires 53*a* are not arranged. However, since the first covering layer 75 is provided on a bottom portion of the trapping groove 80 to cover the output electroconductive wires 53*a*, the output electroconductive wires 53*a* are not exposed to the outside.

According to the ink-jet head 6 having such wiring unit 12, similarly as in a case of the structure according to the fourth embodiment, since it is possible to trap the ink entered from outside in the trapping groove 80, from four sides, and since the trapping groove 80 is provided surrounding entirely the individual supply-terminal group 50*c*, it is possible to prevent the entry of ink from any side (direction) Moreover, the trapping groove 80 may be formed as a recess as described for the cutout 73*a* in the first embodiment. Moreover, the second covering layer 76 of the fifth embodiment and the covering layer 70 of the fourth embodiment may be combined, and a structure may be such that the trapping grooves 80 of the second covering layer 76 and the covering layer 70 coincide (communicate). In this case, by overlapping of the positions of the trapping grooves 80 in the direction of stacking, an ink trapping space of the trapping groove 80 becomes wide, and a trapping effect can be improved.

Sixth Embodiment

Figure 14:
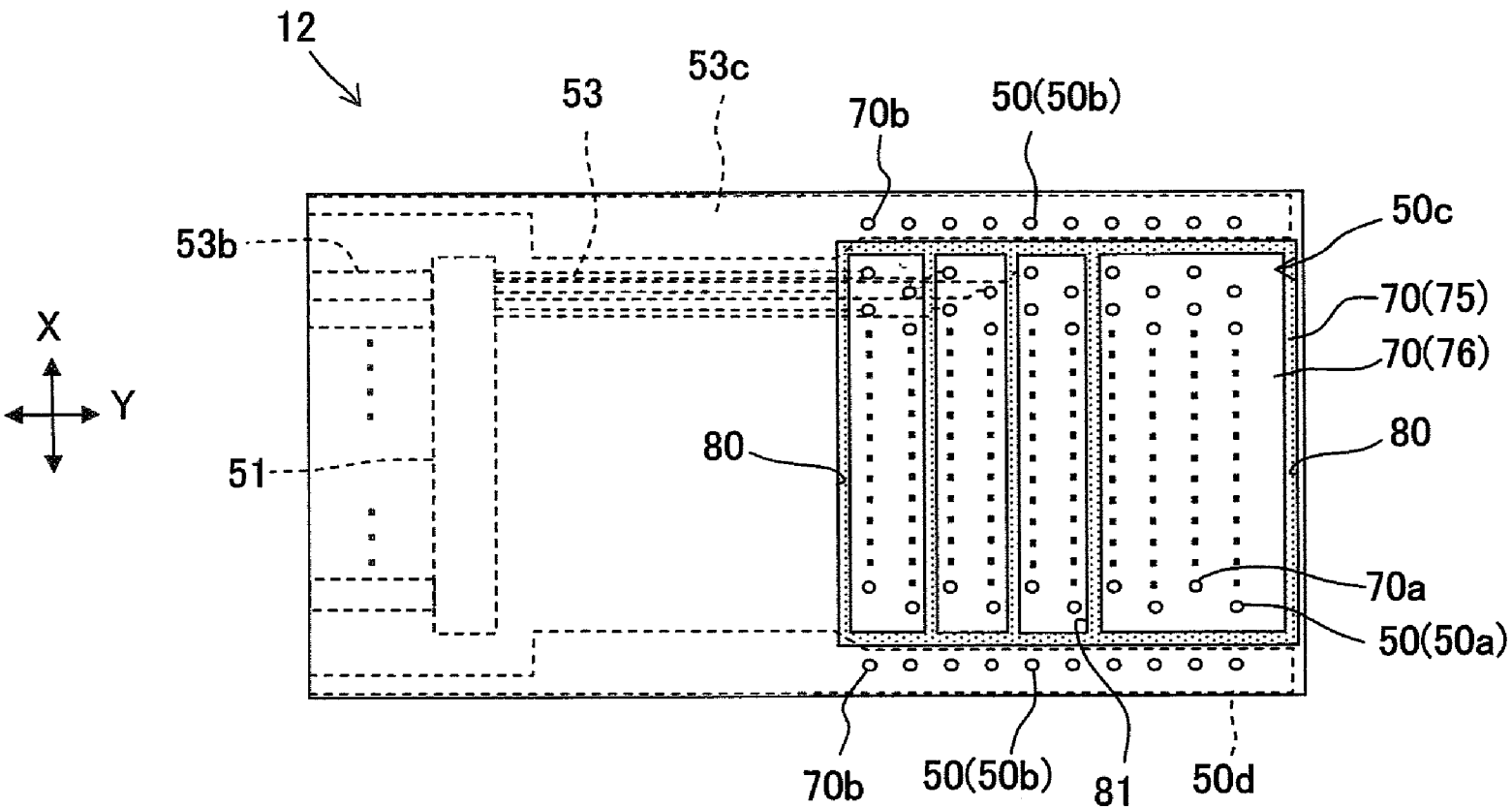
FIG. 14 is a plan view showing still another structure (arrangement) for trapping the liquid which has entered into the gap between the piezoelectric unit and the wiring unit, where, the structure of the wiring unit is shown from the rear-surface side.

FIG. 14 is a plan view showing another structure for trapping the liquid which has entered into the gap between the piezoelectric unit 11 and the wiring unit 12, where the structure of the wiring unit 12 is viewed from the rear surface side (side of the surface facing the piezoelectric unit 11). The wiring unit 12 according to the sixth embodiment has other trapping grooves 81 each running through the individual supply-terminal 50*c*, and this structure is similar to the structure which has already been explained by using FIG. 12 and FIG. 13.

Each of the trapping grooves 81 is extended straight in X direction such that the plurality of individual supply-terminals 50*a* forming the individual supply-terminal group 50*c* are divided into ink channels (nozzle rows) for each of the ink colors. Moreover, the both ends of each of the trapping grooves 81 are connected to the trapping groove 80 surrounding the individual supply-terminal group 50*c*, and the trapping grooves 80 and 81 communicate mutually.

According to the ink-jet head 6 including such wiring unit 12, even when the liquid has presumptively entered inside from the individual supply-terminal group 50*c*, it is possible to trap the ink for each ink channel by the trapping grooves 81. In other words, the trapping groove 80 is divided into several portions corresponding to the ink channels (nozzle rows) each jetting the ink of same color. Therefore, even if the ink has entered inside an area of the individual supply-terminal group 50*c*, a short-circuit of the terminals should occur in a certain ink channel jetting the ink of the same color. Therefore, it is possible to avoid affecting the other ink channels jetting the ink of different colors. For example, an individual supply-terminal group 501*c* and an individual supply-terminal group 502*c* correspond to different ink channels for different color inks, respectively. When the ink enters and when the individual supply-terminals 501*c* and 502*c* are shorted, a jetting defect occurs in both of the ink channels jetting the inks of two colors. However, in the inkjet head according to the sixth embodiment, it is possible to prevent such defect. Moreover, preferably, the trapping groove 80 may be formed in a lattice (grating) form dividing each of the individual supply-terminals 50.

Moreover, since the trapping groove 80 communicates with the trapping grooves 81, the liquid trapped in the trapping groove 80 surrounding the individual supply-terminal 50*c* may be dispersed to the trapping grooves 81 by the capillary phenomenon. Therefore, a capacity of the trapping groove 80 is substantially increased by the capacity of the trapping grooves 81, and it is possible to trap a larger amount of the liquid which has entered from the outside.

The trap groove 80 and the trap grooves 81 need not be necessarily made to communicate. Moreover, in FIG. 14, a structure including three grooves as the trap grooves 81 has been shown. However, it is preferable to have as many trap grooves 81 as possible from a point of view of a substantial increase in the capacity of the trap groove 80.

Furthermore, in a case of a one-layered structure as in the first embodiment, when it is possible to form a recess in the covering layer, only by forming a trap groove as a recess for each ink channel, the same effect can be achieved.

The ink-jet head 6 having a structure as in the forth to sixth embodiments as described above is installed on the supporting plate 5, and the liquid sealing agent 66 is filled in the substantially rectangular-shaped void passage 60 formed between the inner peripheral portion 5*b* of the opening 5*a* and the outer peripheral portion 11*a* of the piezoelectric unit 11 (refer to FIG. 2). In this case, even when the sealing agent is not applied sufficiently in the gap between the connecting surfaces of the piezoelectric unit 11 and the wiring unit 12, it is possible to prevent the unexpected entry of the ink.

Seventh Embodiment

Figure 15:
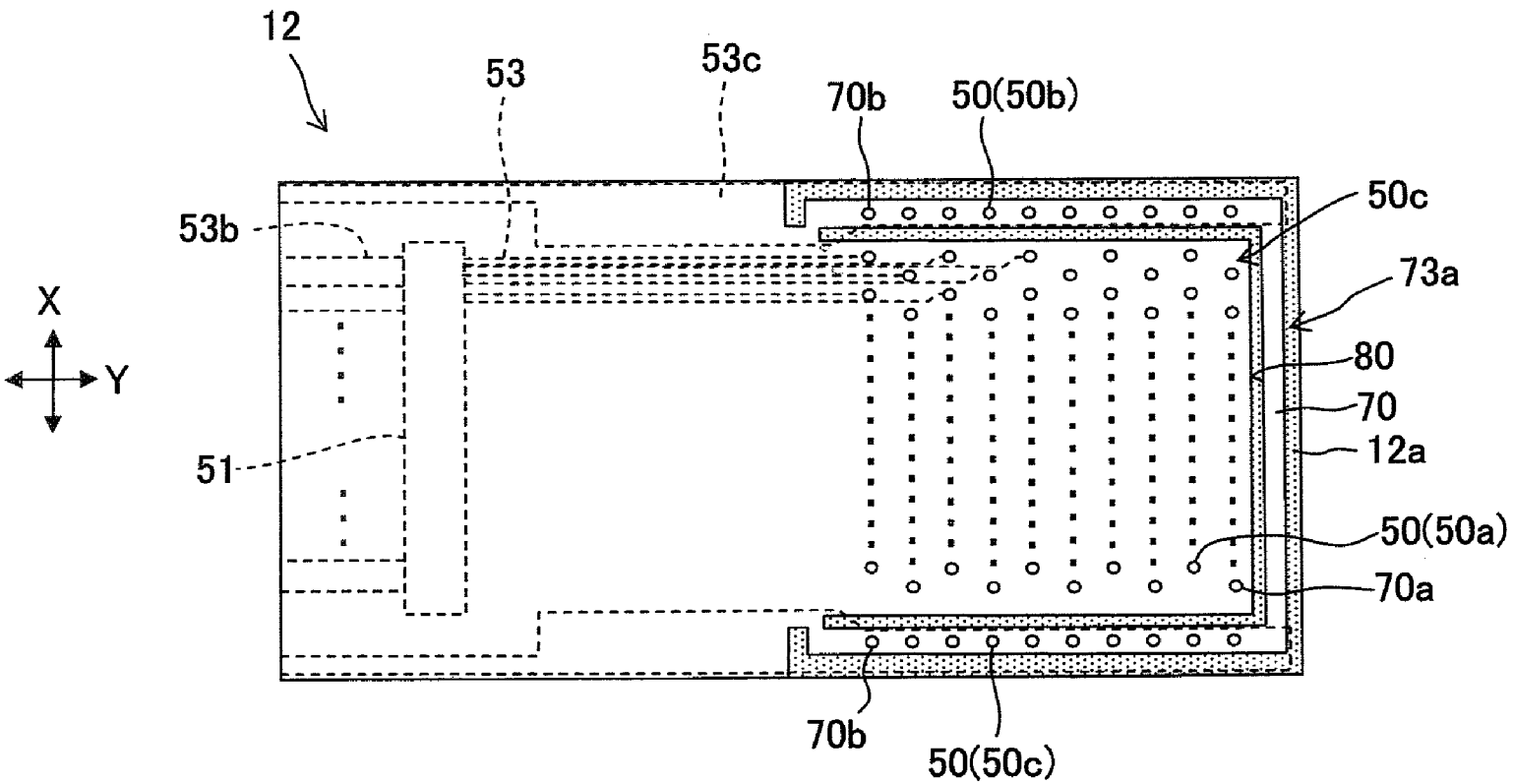
FIG. 15 is a plan view showing still another structure (arrangement) for trapping the liquid which has entered into the gap between the piezoelectric unit and the wiring unit, where, the structure of the wiring unit is shown from the rear-surface side.

FIG. 15 is a plan view showing still another structure (arrangement) for trapping the liquid which has entered into the gap between the piezoelectric unit 11 and the wiring unit 12, where, the structure of the wiring unit 12 is viewed from the rear-surface side (side of the surface facing the piezoelectric unit 11). In the wiring unit 12 according to the seventh embodiment, the cutout 73*a* forming the sealing agent infusing groove 73 described in the first embodiment and the trapping groove 80 described in the fourth embodiment are combined (refer to FIG. 10).

In other words, in the covering layer 70 of the wiring unit 12, the cutout 73*a* is formed in the portion corresponding to the outermost peripheral portion of the piezoelectric unit 11, surrounding the individual supply-terminals 50*a* and the common supply-terminals 50*b* from the outer side, and the wiring unit 12 and the piezoelectric unit 11 are stacked. Then, the cutout 73*a* forms the sealing agent infusing groove 73 which opens toward the outer side similarly as shown in FIG. 5. Moreover, the trapping groove 80 is formed in the covering layer 70, which passes (runs) between the common supply-terminals 50*b* and the individual supply-terminal groups 50*c*, surrounding the individual supply-terminal groups 50*c* from the outer side. Since the rest of the structure is similar as it has already been described, the same reference numerals are assigned to the corresponding components, and detailed description of such components is omitted.

By making such structure (arrangement), it is possible to obtain an action and an effect similar as shown by each structure in the first to fourth embodiments. In other words, it is possible to apply the sealing agent 71 easily to the sealing agent infusing groove 73 formed by the cutout 73*a*, and to prevent the liquid from entering into the gap between the piezoelectric unit 11 and the wiring unit 12. In addition to this, even when the liquid has entered into this gap presumptively, since it is possible to trap the liquid in the trapping groove 80, it is possible to prevent the individual supply-terminals 50*a* from getting shorted by the liquid.

In the seventh embodiment, a combination of the first embodiment and the fourth embodiment has been described. However, it is also possible to make a combination of an arbitrary structure from one of the first embodiment to the third embodiment and an arbitrary structure from one of the fourth embodiment to the sixth embodiment.

Moreover, when the ink-jet head 6 having a structure as in the seventh embodiment described above is installed on the supporting plate 5, and when the liquid sealing agent 66 is filled in the rectangular-shaped void passage 60 formed between the inner peripheral portion 5*b* of the opening 5*a* and the outer peripheral portion 11*a* of the piezoelectric unit 11 (refer to FIG. 2), the liquid sealing agent 66 filled in the void passage 60 is susceptible to be infused into the sealing agent infusing groove 73, thereby making it easy to seal the gap between the connecting surfaces of the piezoelectric unit 11 and the wiring unit 12, and it is possible to prevent the unexpected entry of the ink. Furthermore, even when the sealing agent has not been applied sufficiently in the gap between the connecting surfaces of the piezoelectric unit 11 and the wiring unit 12, it is possible to prevent the unexpected entry of the ink.

The present invention is applicable to a liquid droplet jetting apparatus which is capable of preventing appropriately the individual drive electrodes of the piezoelectric unit and the individual supply-terminals of the wiring unit from getting shorted by the liquid which has entered from outside.

Moreover, the present invention is applicable to a liquid droplet jetting head which is capable of carrying out easily a job of applying a sealing agent, and sealing appropriately an opening portion of a gap between the piezoelectric unit and the wiring unit.

What is claimed is:

1. A liquid droplet jetting head which jets droplets of a liquid, comprising:

a channel unit in which a liquid channel through which the liquid flows is formed;

a piezoelectric unit which is stacked on the channel unit and which applies a jetting pressure to the liquid in the liquid channel, the piezoelectric unit having a plurality of drive portions which are driven by a drive signal, a plurality of individual drive electrodes each of which is connected to one of the drive portions on one surface of the piezoelectric unit, and a common drive electrode which is connected commonly to the drive portions on the one surface of the piezoelectric unit and arranged in the piezoelectric unit on an outer side of the individual drive electrodes; and a wiring unit stacked on the one surface of the piezoelectric unit and having a sheet shaped substrate; an individual supply-terminal group including a plurality of individual supply-terminals provided at positions, of a facing-surface of the wiring unit facing the substrate, corresponding to the individual drive electrodes; a common supply-terminal provided at a position of the facing-surface corresponding to the common drive electrode; and an isolative covering layer which is stacked on the facing-surface, which covers the individual supply-terminals and the common supply-terminal, and in which an opening and a trapping groove are formed, a part of the individual supply-terminals and a part of the common supply-terminal being exposed via the opening, and the trapping groove being arranged in the covering layer at an inner side of a peripheral edge portion of the covering layer corresponding to an outer peripheral edge of the piezoelectric unit to surround the individual supply-terminal group from an outer side of the individual supply-terminal group, wherein the trapping groove is open toward the piezoelectric unit to trap a liquid which enters from outside of the piezoelectric unit.

2. The liquid droplet jetting head according to claim 1, wherein the trapping groove partitions between the individual supply-terminal group and the common supply-terminal.

3. The liquid droplet jetting head according to claim 1, wherein the substrate has a first area which is located at one end side of the substrate and a second area which is extended from the first area to the other end side of the substrate, the first area is connected to the piezoelectric unit, and the individual supply-terminals and the common supply-terminal are provided in the first area; and the wiring unit further has a plurality of individual supply-wires which are connected to the individual supply-terminals respectively, and are extended to the second area.

4. The liquid droplet jetting head according to claim 3, wherein the trapping groove is formed in an area, of the covering layer, surrounding the individual supply-terminal group from the outer side thereof, the area being different from a portion of the covering layer in which the individual supply-terminals, the common supply-terminal, and the individual supply-wires are positioned.

5. The liquid droplet jetting head according to claim 1, wherein the covering layer includes a first covering layer and a second covering layer, the first covering layer facing the substrate and the second covering layer being stacked on the first covering layer to face the piezoelectric unit, and the trapping groove is formed in the second covering layer as a cutout which fully surrounds the individual supply-terminal group.

6. The liquid droplet jetting head according to claim 5, wherein a cutout which is open toward the trapping groove is formed in the first covering layer at a position different from a portion of the first covering layer corresponding to the individual supply-wires.

7. The liquid droplet jetting head according to claim 3, wherein the opening is formed to include a plurality of openings via which the individual supply-terminals are exposed respectively; and the trapping groove is extended between the plurality of openings.

8. A liquid droplet jetting head which jets droplets of a liquid, comprising:

a channel unit in which a liquid channel through which the liquid flows is formed;

a piezoelectric unit which is stacked on the channel unit, which has a drive electrode arranged on one surface of the piezoelectric unit, and which applies a jetting pressure to the liquid in the channel unit, based on a drive signal to the drive electrode; and a wiring unit which is stacked on the one surface of the piezoelectric unit, which has a sheet shaped substrate, a supply-terminal formed on a facing-surface of the substrate facing the piezoelectric unit to be connected with the drive electrode electrically, and an isolative covering layer which is stacked on the facing-surface of the substrate, which covers the supply-terminal, and in which an opening and an introducing groove are formed, a part of the supply-terminal being exposed via the opening toward the piezoelectric unit, and the introducing groove introducing a sealing agent to be applied in the introducing groove, wherein the introducing groove is open at an outer side along an outer peripheral edge of the piezoelectric unit and is formed between the wiring unit and the piezoelectric unit, which are facing mutually, as a cutout formed in the covering layer at a portion corresponding to the outer peripheral edge of the piezoelectric unit.

9. The liquid droplet jetting head according to claim 8, wherein the piezoelectric unit has a plurality of drive portions which are driven by the drive signal applied to the drive electrode; and the drive electrode has a plurality of individual drive electrodes which are connected to the drive portions respectively, and a common drive electrode which is connected commonly to the drive portions, and is arranged in the piezoelectric unit on an outer side of the individual drive electrodes;

the substrate of the wiring unit has a first area which is arranged at one end side of the substrate and a second area which is extended from the first area to the other end side of the substrate, the first area is connected to the piezoelectric unit, the supply-terminal is provided in the first area, and the supply-terminal includes a plurality of individual supply-terminals corresponding to the individual drive electrodes and a common supply-terminal corresponding to the common drive electrode and arranged in the first area at an outer side of the individual supply-terminals; and the wiring unit further has a plurality of individual supply-wires which are connected to the individual supply-terminals and which are extended to the second area, and a common supply-wire which is connected to the common supply-terminal and which is extended to the second area.

10. The liquid droplet jetting head according to claim 9, wherein the introducing groove is formed in an area, of the covering layer, along an outer peripheral edge of the piezoelectric unit, the area being different from a portion of the first area in which the individual supply-terminals, the common supply-terminal, and the individual supply-wires are formed.

11. The liquid droplet jetting head according to claim 8, wherein the covering layer includes a first covering layer and a second covering layer, the first covering layer facing the substrate and the second covering layer being stacked on the first covering layer to face the piezoelectric unit, and the introducing groove is formed as a cutout in the second covering layer at a portion corresponding to the outer peripheral edge of the piezoelectric unit.

12. The liquid droplet jetting head according to claim 11, wherein a cutout which is open toward an outer side of the piezoelectric unit is formed in an area of the first covering layer along the outer peripheral edge of the piezoelectric unit, and the area is different from a portion, of the first covering layer, in which the individual supply-terminals, the common supply-terminal, and the individual supply-wire are positioned.

13. The liquid droplet jetting head according to claim 8, wherein a trapping groove is formed in the covering layer at an inner side of the peripheral edge portion of the covering layer to surround the supply-terminal, and the trapping groove is open toward the piezoelectric unit to trap a liquid which enters from outside of the piezoelectric unit.

* * * * *